US011209175B2

(12) United States Patent
Kurokawa et al.

(10) Patent No.: US 11,209,175 B2
(45) Date of Patent: Dec. 28, 2021

(54) OUTDOOR UNIT FOR REFRIGERATION APPARATUS

(71) Applicant: Daikin Industries, LTD., Osaka (JP)

(72) Inventors: Miho Kurokawa, Osaka (JP); Shigeki Kamitani, Osaka (JP); Taichi Koshiji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/626,622

(22) PCT Filed: Aug. 6, 2018

(86) PCT No.: PCT/JP2018/029405
§ 371 (c)(1),
(2) Date: Dec. 26, 2019

(87) PCT Pub. No.: WO2019/031450
PCT Pub. Date: Feb. 14, 2019

(65) Prior Publication Data

US 2020/0158354 A1 May 21, 2020

(30) Foreign Application Priority Data

Aug. 9, 2017 (JP) ..... JP2017-154721

(51) Int. Cl.
*F24F 1/22* (2011.01)
*F24F 13/20* (2006.01)

(52) U.S. Cl.
CPC ..... *F24F 1/22* (2013.01); *F24F 13/20* (2013.01)

(58) Field of Classification Search
CPC ..... F24F 1/22; F24F 13/20
See application file for complete search history.

(56) References Cited

U.S. PATENT DOCUMENTS 8,464,548 B2 * 6/2013 Okuda ..... F24F 13/20 62/259.2
10,753,639 B2 * 8/2020 Komatsu ..... F24F 1/0007
(Continued)

FOREIGN PATENT DOCUMENTS

EP 2206978 A1 7/2010
JP 2001-099449 A 4/2001
(Continued)

OTHER PUBLICATIONS

Extended European Search Report issued in corresponding European Patent Application No. 18843136.5 dated Jun. 30, 2020 (7 pages).
(Continued)

*Primary Examiner* — Filip Zec
(74) *Attorney, Agent, or Firm* — Osha Bergman Watanabe & Burton LLP

(57) ABSTRACT

An outdoor unit for a refrigeration apparatus includes: a casing that houses a plurality of devices including a first device and a second device; a plurality of electric components including a first electric component and a second electric component; an electric component box disposed in the casing and that houses the plurality of electric components; a first wire that carries a first voltage or current between the first electric component and the first device; a second wire that carries a second voltage or current between the second electric component and the second device; and a cover part that suppresses entry of liquid into the electric component box. The second voltage or current is lower than the first voltage or current.

15 Claims, 28 Drawing Sheets

(56) References Cited

U.S. PATENT DOCUMENTS

| | | | | |
|---|---|---|---|---|
| 2008/0011001 | A1 | 1/2008 | Katsuyama | |
| 2010/0202111 | A1* | 8/2010 | Liang | H05K 5/064 361/720 |
| 2014/0117825 | A1* | 5/2014 | Lee | F24F 1/22 312/237 |
| 2016/0258636 | A1* | 9/2016 | Kim | F24F 13/20 |
| 2019/0145637 | A1* | 5/2019 | Onuki | F24F 1/24 62/440 |

FOREIGN PATENT DOCUMENTS

| | | | |
|---|---|---|---|
| JP | 2008-082638 | A | 4/2008 |
| JP | 2008-144982 | A | 6/2008 |
| JP | 2008-175411 | A | 7/2008 |
| JP | 2014-047991 | A | 3/2014 |
| JP | 2014-240727 | A | 12/2014 |
| WO | 2016/136529 | A1 | 9/2016 |

OTHER PUBLICATIONS

International Search Report issued in corresponding International Application No. PCT/JP2018/029405 dated Nov. 6, 2018 (3 pages).
International Preliminary Report on Patentability issued in corresponding International Application No. PCT/JP2018/029405 dated Feb. 20, 2020 (15 pages).
Notice of Reasons for Refusal issued in corresponding Japanese Patent Application No. 2017-154721 dated Oct. 30, 2018 (10 pages).
Notice of Reasons for Refusal issued in corresponding Japanese Patent Application No. 2017-154721 dated Apr. 23, 2019 (10 pages).

* cited by examiner

OUTDOOR UNIT FOR REFRIGERATION APPARATUS

TECHNICAL FIELD

The present invention relates to an outdoor unit for a refrigeration apparatus.

BACKGROUND

In an outdoor unit for a refrigeration apparatus, typically, a compressor is disposed on a bottom plate of a casing, and an electric component for power supply to the compressor is housed in an electric component box disposed in the casing. It has been considered that an electric wire (a power supply wire) connecting the compressor to the electric component for power supply to the compressor is drawn into the electric component box, in which the electric component is housed, from a lateral side of the electric component box for the purpose of cost cutting, noise reduction, or ease of wiring by reduction in longitudinal length. For example, Patent Literature 1 (JP 2008-144982 A) discloses an outdoor unit for a refrigeration apparatus, the outdoor unit having a configuration in which a compressor is disposed on a bottom plate of a casing, and a power supply wire is drawn into an electric component box from a lateral side of the electric component box.

Electric wires to be drawn into an electric component box include: a wire (a high-voltage wire) for supplying electric power as a power source for a device (e.g., an actuator such as a compressor, a heater); and a wire (a low-voltage wire) for sending a control signal to be exchanged between devices (e.g., a sensor, a microcomputer). Typically, a low-voltage wire carries a voltage or a current smaller in value than a voltage or a current fed to a high-voltage wire. If the low-voltage wire and the high-voltage wire are disposed in proximity to each other, the low-voltage wire may generate noise. In order to suppress decrease in reliability, normally, the low-voltage wire and the high-voltage wire are separately drawn into an electric component box.

Meanwhile, an outdoor unit for a refrigeration apparatus requires countermeasures against the entry of liquid into an electric component box. However, the countermeasures are taken individually for a portion where a high-voltage wire is drawn and a portion where a low-voltage wire is drawn, which may result in increase in cost.

PATENT LITERATURE

Patent Literature 1: JP 2008-144982 A

SUMMARY

Hence, the present invention provides an outdoor unit for a refrigeration apparatus, the outdoor unit being capable of suppressing decrease in reliability and also suppressing increase in cost.

According to one or more embodiments of the present invention, an outdoor unit for a refrigeration apparatus includes a casing, an electric component, an electric component box, a first wire, a second wire, and a cover part. The casing houses therein a plurality of devices. The electric component includes a first electric component and a second electric component.

The electric component box is disposed in the casing. The electric component box houses therein the electric component. The first wire is configured to carry a voltage or a current between the first electric component and any one of the devices. The second wire is configured to carry a voltage or a current between the second electric component and another one of the devices, the voltage or current being smaller in value than the voltage or current fed to the first wire. The cover part is configured to suppress (i.e., prevent) entry of liquid into the electric component box. The electric component box has in its lateral side a first opening and a second opening. The first opening is an opening through which the first wire is drawn into the electric component box. The second opening is an opening through which the second wire is drawn into the electric component box. The cover part is disposed on an outer face of the electric component box, and is located along the first opening and the second opening. The cover part covers both the first opening and the second opening from above and from sideward.

In the outdoor unit according to one or more embodiments of the present invention, the cover part configured to suppress the entry of liquid into the electric component box is disposed on the outer face of the electric component box, and is located along the first opening through which the first wire is drawn and the second opening through which the second wire is drawn. In addition, the cover part covers both the first opening and the second opening from above and from sideward. With this configuration, the first wire and the second wire are separately drawn into the electric component box, and the first opening through which the first wire is drawn and the second opening through which the second wire is drawn are covered with the common cover part. This configuration therefore simply and accurately suppresses the entry of liquid into the electric component box while achieving reduction in parts count. This configuration thus suppresses decrease in reliability, and also suppresses increase in cost for suppressing the entry of liquid into the electric component box.

The "first wire" used herein refers to a wire (i.e., a high-voltage wire) mainly for supplying electric power as a power source for a device (e.g., an actuator such as a motor, a heater). The "second wire" used herein refers to a wire (i.e., a low-voltage wire) mainly for sending a control signal to be exchanged between devices (e.g., a sensor, a microcomputer). This wire particularly tends to generate noise when being disposed in proximity to the first wire within a predetermined distance (e.g., 3 cm). The voltage value and current value of each of the "first wire" and the "second wire" are appropriately selected in accordance with design specifications and installation environments. For example, the "first wire" carries a voltage that is equal to or more than 50 V or a current related to the voltage. For example, the "second wire" carries a voltage that is equal to or less than 15 V or a current related to the voltage.

The "devices" used herein refer to devices that constitute a refrigeration apparatus. Examples of the "devices" include any of or all of a compressor, a fan, an electric valve, an electromagnetic valve, a heater, a temperature sensor, and a pressure sensor.

According to one or more embodiments of the present invention, in the outdoor unit for the refrigeration apparatus, the devices include a fan. The fan is configured to provide an air flow. The casing has a blow-out port. The blow-out port is an opening through which an air flow is blown out upward. The air flow is a flow of air flowing from below upward in the casing and flowing out of the casing through the blow-out port.

The outdoor unit according to one or more embodiments of the present invention suppresses the entry of liquid into the electric component box while reducing cost even when the outdoor unit is an outdoor unit having a blow-out port through which an air flow is blown out upward (i.e., an outdoor unit particularly having a concern of the entry of liquid into a casing through a blow-out port).

According to one or more embodiments of the present invention, in the outdoor unit for the refrigeration apparatus, the electric component box or the cover part has a partition. The partition separates the first wire to be drawn into the first opening from the second wire to be drawn into the second opening.

This configuration suppresses (i.e., prevents) a situation in which the first wire to be drawn into the first opening and the second wire to be drawn into the second opening are disposed in proximity to each other. As a result, the second wire is less prone to suffer from noise to be caused when the second wire is disposed in proximity to the first wire. This configuration thus further suppresses decrease in reliability.

According to one or more embodiments of the present invention, the outdoor unit for the refrigeration apparatus further includes a board. The electric component is mounted on the board. The first opening and the second opening are lower in heightwise position than an upper end of the board and higher in heightwise position than a lower end of the board.

In the outdoor unit according to one or more embodiments of the present invention, the first opening and the second opening are lower in heightwise position than the upper end of the board and higher in heightwise position than the lower end of the board. The first opening and the second opening may therefore be located in proximity to each other. As a result, the cover part readily covers both the first opening and the second opening, which facilitates cost cutting.

According to one or more embodiments of the present invention, in the outdoor unit for the refrigeration apparatus, the electric component box has a wire through-hole. The wire through-hole serves as both of the first opening and the second opening. The first wire and the second wire are separately drawn into the electric component box through the wire through-hole. The cover part is located along the wire through-hole. The cover part covers the wire through-hole from above and from sideward.

In the outdoor unit according to one or more embodiments of the present invention, the first wire and the second wire are separately drawn into the electric component box through the wire through-hole serving as both of the first opening and the second opening. With this configuration, the cover part readily covers both the portion where the first wire is drawn and the portion where the second wire is drawn, which further facilitates cost cutting.

According to one or more embodiments of the present invention, the outdoor unit for the refrigeration apparatus includes a plurality of the first wires, the number of which is equal to or more than 15, to be drawn into the first opening, and a plurality of the second wires, the number of which is equal to or more than 15, to be drawn into the second opening.

The outdoor unit according to one or more embodiments of the present invention suppresses decrease in reliability, and also suppresses increase in cost for suppressing the entry of liquid into the electric component box even when the number of electric wires to be drawn into the electric component box is large, leading to a concern particularly about decrease in reliability owing to noise and increase in cost for suppressing the entry of liquid.

According to one or more embodiments of the present invention, in the outdoor unit for the refrigeration apparatus, the cover part has a lower opening that is open downward. The first wire and the second wire are drawn into the cover part and the electric component box through the lower opening. This configuration simplifies the cover part configured to suppress the entry of liquid into the first opening and second opening.

According to one or more embodiments of the present invention, in the outdoor unit for the refrigeration apparatus, the cover part includes a first cover member and a second cover member. The second cover member is located above the first cover member. The second cover member covers the first cover member from above. This configuration further suppresses the entry of liquid into the electric component box.

In the outdoor unit according to one or more embodiments of the present invention, the first wire and the second wire are separately drawn into the electric component box, and the first opening through which the first wire is drawn and the second opening through which the second wire is drawn are covered with the common cover part. This configuration therefore simply and accurately suppresses the entry of liquid into the electric component box while achieving reduction in parts count. This configuration thus suppresses decrease in reliability, and also suppresses increase in cost for suppressing the entry of liquid into the electric component box.

The outdoor unit according to one or more embodiments of the present invention suppresses the entry of liquid into the electric component box while reducing cost even when the outdoor unit is an outdoor unit having a blow-out port through which an air flow is blown out upward (i.e., an outdoor unit particularly having a concern of the entry of liquid into a casing through a blow-out port).

The outdoor unit according to one or more embodiments of the present invention further suppresses decrease in reliability.

The outdoor unit according to one or more embodiments of the present invention facilitates cost cutting.

The outdoor unit according to one or more embodiments of the present invention further facilitates cost cutting.

The outdoor unit according to one or more embodiments of the present invention suppresses decrease in reliability, and also suppresses increase in cost for suppressing the entry of liquid into the electric component box even when the number of electric wires to be drawn into the electric component box is large, leading to a concern particularly about decrease in reliability owing to noise and increase in cost for suppressing the entry of liquid.

The outdoor unit according to one or more embodiments of the present invention adopts the simplified cover part configured to suppress the entry of liquid into the first opening and the second opening.

The outdoor unit according to one or more embodiments of the present invention further suppresses the entry of liquid into the electric component box.

DETAILED DESCRIPTION

An outdoor unit 10 according to one or more embodiments of the present invention will be described below with reference to the drawings. It should be noted that the following embodiments are merely specific examples of the present invention, do not intend to limit the technical scope of the present invention, and may be appropriately modified without departing from the gist of the present invention. In the following description, the terms "upper", "lower", "left", "right", "front", "rear", "front face", and "rear face" denote directions illustrated in FIGS. 2 to 28, unless otherwise specified (provided that the left side and the right side and/or the front side and the rear side may be turned appropriately in the following embodiments).

The outdoor unit 10 according to one or more embodiments of the present invention is applied to an air conditioning system 100 (a refrigeration apparatus).

(1) Air Conditioning System 100

Figure 1:
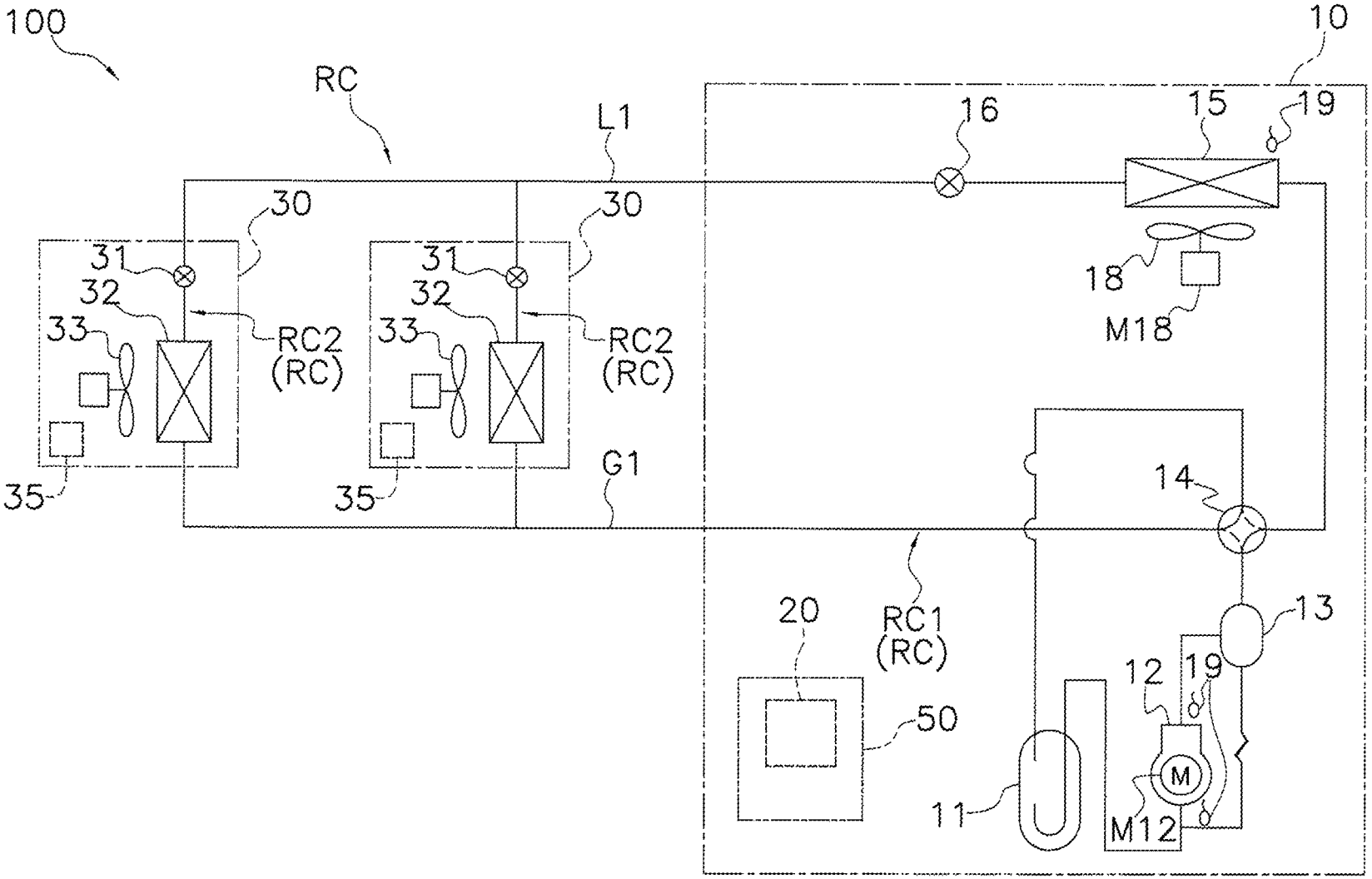
FIG. 1 is a schematic configuration diagram of an air conditioning system including an outdoor unit according to one or more embodiments of the present invention.

FIG. 1 is a schematic configuration diagram of the air conditioning system 100 including the outdoor unit 10 according to one or more embodiments of the present invention. The air conditioning system 100 is configured to perform air conditioning, such as cooling or heating, in a target space (a residential space, a space to be subjected to air conditioning in, for example, a store house) by a vapor compression refrigeration cycle. The air conditioning system 100 mainly includes the outdoor unit 10, a plurality of (two according to the embodiments) indoor units 30 (30*a*, 30*b*), a liquid-side connection pipe L1, and a gas-side connection pipe G1.

In the air conditioning system 100, the outdoor unit 10 and the indoor units 30 are connected via the liquid-side connection pipe L1 and the gas-side connection pipe G1 to constitute a refrigerant circuit RC. The air conditioning system 100 performs a refrigeration cycle to compress, cool or condense, decompress, heat or evaporate, and then compress again a refrigerant in the refrigerant circuit RC.

(1-1) Outdoor Unit 10

The outdoor unit 10 is installed in outdoor space. The outdoor space refers to space other than a target space to be subjected to air conditioning, and examples thereof include the outside such as the roof of a building, and underground space. The outdoor unit 10 is connected to the indoor units 30 via the liquid-side connection pipe L1 and the gas-side connection pipe G1 to constitute a part (an outdoor-side circuit RC1) of the refrigerant circuit RC. The outdoor unit 10 mainly includes an accumulator 11, a compressor 12, an oil separator 13, a four-way switching valve 14, an outdoor heat exchanger 15, an outdoor expansion valve 16, and the like as devices that constitute the outdoor-side circuit RC1. These devices (11 to 16) are connected to one another via refrigerant pipes.

The accumulator 11 is a container configured to store the refrigerant and to separate the gas refrigerant from the liquid refrigerant, so as to suppress excessive suction of the liquid refrigerant into the compressor 12.

The compressor 12 is a device configured to compress the low-pressure refrigerant to the high-pressure refrigerant in the refrigeration cycle. The compressor 12 according to one or more embodiments is a hermetic compressor in which a displacement, such as rotary or scroll, compression element is driven to rotate by a compressor motor M12. The compressor motor M12 has an operating frequency controllable by an inverter, and controlling the operating frequency enables capacity control for the compressor 12. The start, stop, and operating capacity of the compressor 12 are controlled by an outdoor unit control unit 20.

The oil separator 13 is a container configured to separate a refrigerating machine oil compatible with the refrigerant discharged from the compressor 12 and to return the refrigerating machine oil to the compressor 12.

The four-way switching valve 14 is a flow path switching valve for switching a flow of the refrigerant in the refrigerant circuit RC.

The outdoor heat exchanger 15 is a heat exchanger that functions as a condenser (or a radiator) or an evaporator for the refrigerant.

The outdoor expansion valve 16 is an electric valve whose opening degree is controllable. The outdoor expansion valve 16 decompresses the incoming refrigerant or adjusts the flow rate of the incoming refrigerant, in accordance with the opening degree.

The outdoor unit 10 also includes an outdoor fan 18 (which is an example of a "fan" in the claims) configured to provide an outdoor air flow AF. The outdoor air flow AF (which is an example of an "air flow" in the claims) is a flow of air flowing into the outdoor unit 10 from the outside of the outdoor unit 10 and passing through the outdoor heat exchanger 15. The outdoor air flow AF serves as a cooling source or a heating source for the refrigerant flowing through the outdoor heat exchanger 15. The outdoor air flow AF passing through the outdoor heat exchanger 15 exchanges heat with the refrigerant in the outdoor heat exchanger 15. The outdoor fan 18 includes an outdoor fan motor M18, and is driven in conjunction with the outdoor fan motor M18. The start, stop, and number of rotations of the outdoor fan 18 are appropriately controlled by the outdoor unit control unit 20.

The outdoor unit 10 also includes a plurality of outdoor-side sensors 19 each configured to detect a state (mainly, a pressure, a temperature) of the refrigerant in the refrigerant circuit RC. Each of the outdoor-side sensors 19 is a pressure sensor or a temperature sensor such as a thermistor or a thermocouple. The outdoor-side sensors 19 include, for example, a suction pressure sensor configured to detect a suction pressure that is a pressure of the refrigerant at the suction side of the compressor 12, a discharge pressure sensor configured to detect a discharge pressure that is a pressure of the refrigerant at the discharge side of the compressor 12, and a temperature sensor configured to detect a temperature of the refrigerant in the outdoor heat exchanger 15.

The outdoor unit 10 also includes the outdoor unit control unit 20 configured to control operations and states of the devices in the outdoor unit 10. The outdoor unit control unit 20 includes: a microcomputer including a central processing unit (CPU), a memory, and the like, and various electric components (e.g., a capacitor, a semiconductor element, a coil component). The outdoor unit control unit 20 is electrically connected to the devices (e.g., 12, 14, 16, 18) and outdoor-side sensors 19 in the outdoor unit 10 to exchange signals with the devices and outdoor-side sensors 19. The outdoor unit control unit 20 also exchanges, for example, control signals with indoor unit control units 35 of the respective indoor units 30 and remote controllers (not illustrated). The outdoor unit control unit 20 is housed in an electric component box 50 to be described later.

A specific description on the structure of the outdoor unit 10 will be given later.

(1-2) Indoor Units 30

Each indoor unit 30 is installed in the interior (e.g., a residential room, a roof-space), and constitutes a part (an indoor-side circuit RC2) of the refrigerant circuit RC. Each indoor unit 30 mainly includes an indoor expansion valve 31, an indoor heat exchanger 32, and the like as devices that constitute the indoor-side circuit RC2.

The indoor expansion valve 31 is an electric valve whose opening degree is controllable. The indoor expansion valve 31 decompresses the incoming refrigerant or adjusts the flow rate of the incoming refrigerant, in accordance with the opening degree.

The indoor heat exchanger 32 is a heat exchanger that functions as an evaporator or a condenser (or a radiator) for the refrigerant.

Each indoor unit 30 also includes an indoor fan 33 for sucking air inside a target space, allowing the air to pass through the indoor heat exchanger 32, causing the air to exchange heat with the refrigerant in the indoor heat exchanger 32, and then supplying the air to the target space again. The indoor fan 33 includes an indoor fan motor serving as a drive source. The indoor fan 33 is driven to provide an indoor air flow. The indoor air flow is a flow of air that flows into each indoor unit 30 from the target space, passes through the indoor heat exchanger 32, and then is blown out of the indoor unit 30 toward the target space. The indoor air flow serves as a heating source or a cooling source for the refrigerant flowing through the indoor heat exchanger 32. The indoor air flow passing through the indoor heat exchanger 32 exchanges heat with the refrigerant in the indoor heat exchanger 32.

Each indoor unit 30 also includes the indoor unit control unit 35 configured to control operations and states of the devices (e.g., 35) in the indoor unit 30. The indoor unit control unit 35 includes: a microcomputer including a CPU, a memory, and the like; and various electric components.

(1-3) Liquid-side Connection Pipe L1, Gas-side Connection Pipe G1

Each of the liquid-side connection pipe L1 and the gas-side connection pipe G1 is a refrigerant connection pipe for connecting the outdoor unit 10 to each of the indoor units 30, and is constructed on site. The pipe lengths and pipe diameters of the liquid-side connection pipe L1 and gas-side connection pipe G1 are appropriately selected in accordance with design specifications and installation environments.

(2) Flow of Refrigerant in Refrigerant Circuit RC

Next, a description will be given of the flow of the refrigerant in the refrigerant circuit RC. The air conditioning system 100 mainly performs a forward cycle operation and a reverse cycle operation. The low pressure in the refrigeration cycle is a pressure (a suction pressure) of the refrigerant sucked into the compressor 12, and the high pressure in the refrigeration cycle is a pressure (a discharge pressure) of the refrigerant discharged from the compressor 12.

(2-1) Flow of Refrigerant During Forward Cycle Operation

During the forward cycle operation (e.g., a cooling operation), the four-way switching valve 14 is in a forward cycle state (a state indicated by a solid line in the four-way switching valve 14 illustrated in FIG. 1). When the forward cycle operation is started, the refrigerant is sucked into and compressed by the compressor 12, and then is discharged from the compressor 12, in the outdoor-side circuit RC1. The compressor 12 is subjected to capacity control according to a heating load to be required for an indoor unit 30 under operation. Specifically, an operating frequency of the compressor 12 is controlled such that the suction pressure takes a target value set in accordance with the heating load to be required for the indoor unit 30. The gas refrigerant discharged from the compressor 12 flows into the outdoor heat exchanger 15.

When the gas refrigerant flows into the outdoor heat exchanger 15, the outdoor heat exchanger 15 causes the gas refrigerant to radiate heat by heat exchange with an outdoor air flow AF supplied by the outdoor fan 18, and then condenses the gas refrigerant. When the refrigerant flows out of the outdoor heat exchanger 15, then the refrigerant passes through the outdoor expansion valve 16. The outdoor expansion valve 16 decompresses the refrigerant or adjusts the flow rate of the refrigerant, in accordance with the opening degree of the outdoor expansion valve 16. The refrigerant then flows out of the outdoor-side circuit RC1. When the refrigerant flows out of the outdoor-side circuit RC1, then the refrigerant flows into the indoor-side circuit RC2 of the indoor unit 30 under operation, via the liquid-side connection pipe L1.

When the refrigerant flows into the indoor-side circuit RC2 of the indoor unit 30 under operation, then the refrigerant flows into the indoor expansion valve 31. The indoor expansion valve 31 decompresses the refrigerant to the low pressure in the refrigeration cycle, in accordance with the opening degree of the indoor expansion valve 31. The refrigerant then flows into the indoor heat exchanger 32. When the refrigerant flows into the indoor heat exchanger 32, the indoor heat exchanger 32 evaporates the refrigerant by heat exchange with an indoor air flow supplied by the indoor fan 33, thereby turning the refrigerant into the gas refrigerant. The gas refrigerant then flows out of the indoor heat exchanger 32. When the gas refrigerant flows out of the indoor heat exchanger 32, the gas refrigerant then flows out of the indoor-side circuit RC2.

When the refrigerant flows out of the indoor-side circuit RC2, then the refrigerant flows into the outdoor-side circuit RC1 via the gas-side connection pipe G1. When the refrigerant flows into the outdoor-side circuit RC1, then the refrigerant flows into the accumulator 11. When the refrigerant flows into the accumulator 11, then the refrigerant is temporarily stored in the accumulator 11. Thereafter, the refrigerant is sucked into the compressor 12 again.

(2-2) Flow of Refrigerant During Reverse Cycle Operation

During the reverse cycle operation (e.g., a heating operation), the four-way switching valve 14 is in a reverse cycle state (a state indicated by a broken line in the four-way switching valve 14 illustrated in FIG. 1). When the reverse cycle operation is started, the refrigerant is sucked into and compressed by the compressor 12, and then is discharged from the compressor 12, in the outdoor-side circuit RC1. As in the forward cycle operation, the compressor 12 is subjected to capacity control according to a heating load to be required for an indoor unit 30 under operation. When the gas refrigerant is discharged from the compressor 12, then the gas refrigerant flows out of the outdoor-side circuit RC1. The gas refrigerant then flows into the indoor-side circuit RC2 of the indoor unit 30 under operation, via the gas-side connection pipe G1.

When the refrigerant flows into the indoor-side circuit RC2, then the refrigerant flows into the indoor heat exchanger 32. The indoor heat exchanger 32 condenses the refrigerant by heat exchange with an indoor air flow supplied by the indoor fan 33. When the refrigerant flows out of the indoor heat exchanger 32, then the refrigerant flows into the indoor expansion valve 31. The indoor expansion valve 31 decompresses the refrigerant to the low pressure in the refrigeration cycle, in accordance with the opening degree of the indoor expansion valve 31. The refrigerant then flows out of the indoor-side circuit RC2.

When the refrigerant flows out of the indoor-side circuit RC2, then the refrigerant flows into the outdoor-side circuit RC1 via the liquid-side connection pipe L1. When the refrigerant flows into the outdoor-side circuit RC1, then the refrigerant flows into the outdoor heat exchanger 15 through a liquid-side port of the outdoor heat exchanger 15.

When the refrigerant flows into the outdoor heat exchanger 15, the outdoor heat exchanger 15 evaporates the refrigerant by heat exchange with an outdoor air flow AF supplied by the outdoor fan 18. When the refrigerant flows out of the outdoor heat exchanger 15 through a gas-side port of the outdoor heat exchanger 15, then the refrigerant flows into the accumulator 11. When the refrigerant flows into the accumulator 11, then the refrigerant is temporarily stored in the accumulator 11. Thereafter, the refrigerant is sucked into the compressor 12 again.

(3) Details of Outdoor Unit 10

Figure 2:
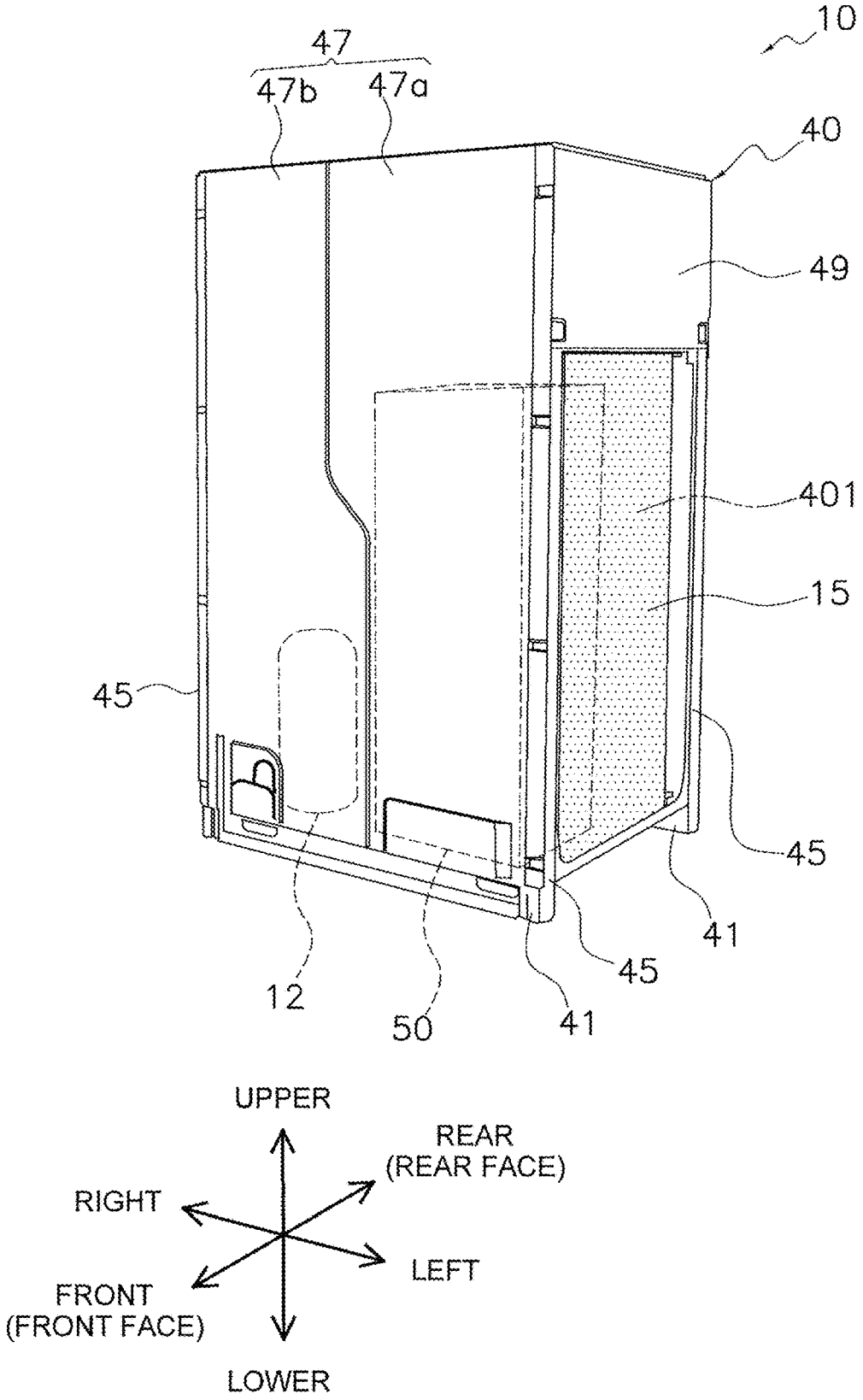
FIG. 2 is a front perspective view of the outdoor unit.
Figure 3:
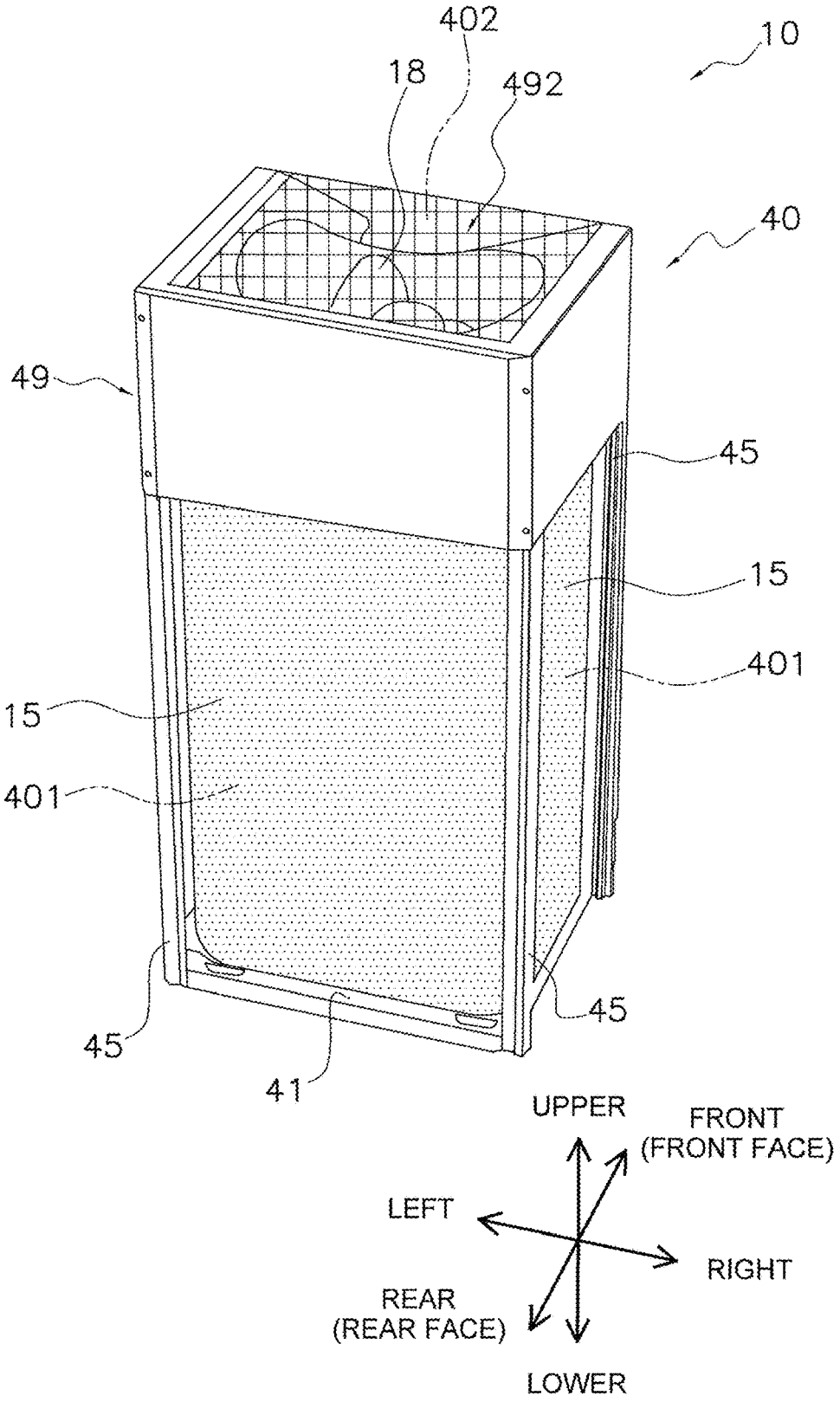
FIG. 3 is a rear perspective view of the outdoor unit.
Figure 4:
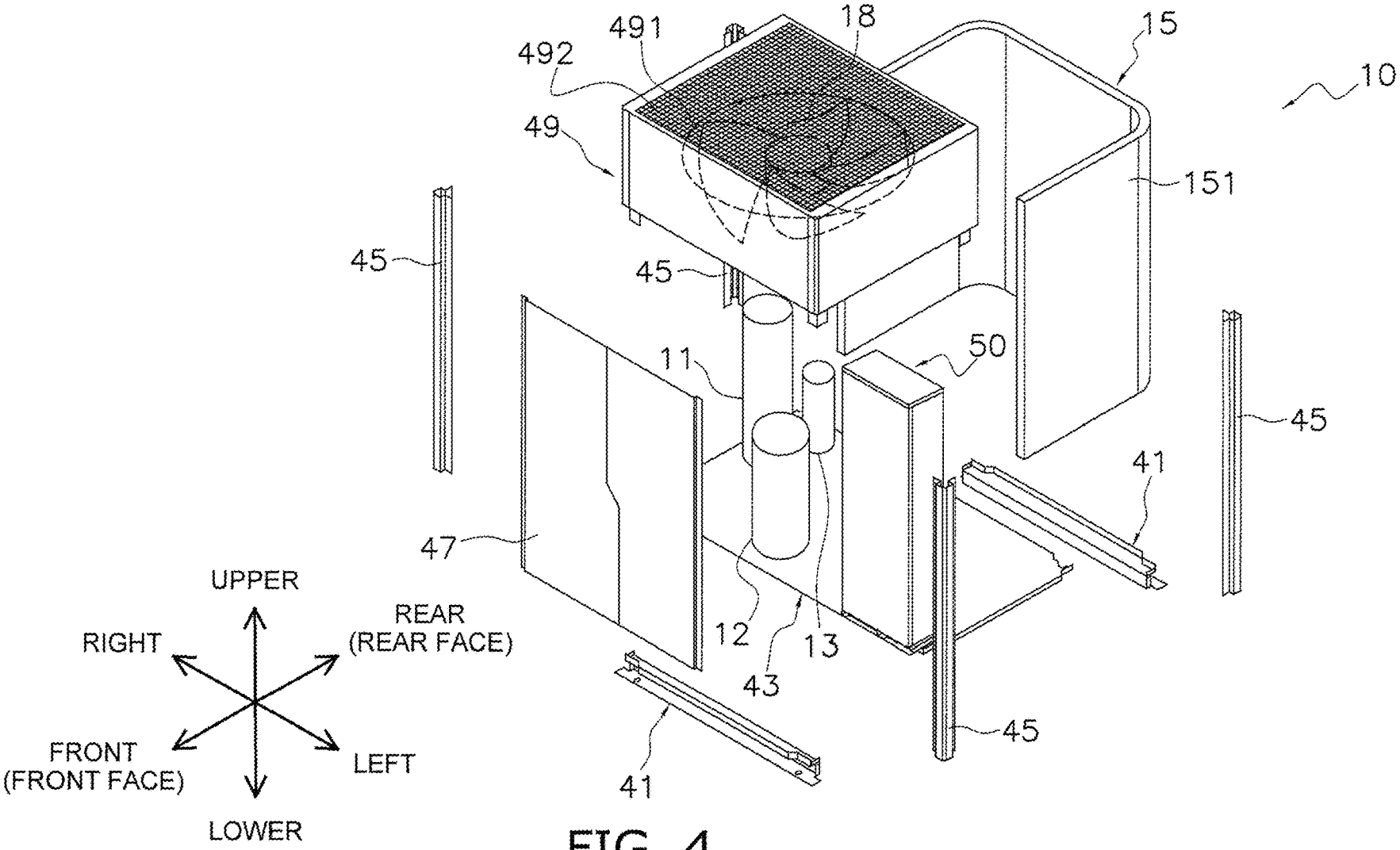
FIG. 4 is a schematic exploded view of the outdoor unit.

FIG. 2 is a front perspective view of the outdoor unit 10. FIG. 3 is a rear perspective view of the outdoor unit 10. FIG. 4 is a schematic exploded view of the outdoor unit 10.

(3-1) Outdoor Unit Casing 40

The outdoor unit 10 includes an outdoor unit casing 40 constituting an outer contour and housing therein the devices (e.g., 11, 12, 13, 14, 15, 16, 20). The outdoor unit casing 40 (which is an example of a "casing" in the claims) has substantially a parallelepiped shape, and includes an assembly of sheet metal members. The outdoor unit casing 40 has openings formed in its left side face, right side face, and rear face so as to mostly occupy the left side face, right side face, and rear face. These openings function as intake ports 401 through which outdoor air flows AF are sucked.

The outdoor unit casing 40 mainly includes a pair of installation legs 41, a bottom frame 43, a plurality of (four in one or more embodiments) supports 45, a front face panel 47, and a fan module 49.

Each of the installation legs 41 is a sheet metal member extending in the left-right direction and supporting the bottom frame 43 from below. The installation legs 41 are respectively located near a front end and a rear end of the outdoor unit casing 40.

The bottom frame 43 is a sheet metal member constituting a bottom face portion of the outdoor unit casing 40. The bottom frame 43 is disposed on the pair of installation legs 41. The bottom frame 43 has substantially a rectangular shape in plan view.

The supports 45 extend vertically from corner portions of the bottom frame 43, respectively. As illustrated in FIGS. 2 to 4, the supports 45 extend vertically from the four corner portions of the bottom frame 43, respectively.

The front face panel 47 is a sheet metal member constituting a front face portion of the outdoor unit casing 40. More specifically, the front face panel 47 includes a first front face panel 47*a* and a second front face panel 47*b*. The first front face panel 47*a* constitutes a left side of the front face portion of the outdoor unit casing 40. The second front face panel 47*b* constitutes a right side of the front face portion of the outdoor unit casing 40. The first front face panel 47*a* and the second front face panel 47*b* are positioned with respect to the outdoor unit casing 40. The first front face panel 47*a* and the second front face panel 47*b* are then fastened to the supports 45 with screws. The first front face panel 47*a* and the second front face panel 47*b* are thus secured to the supports 45 independently of each other.

The fan module 49 is mounted to the supports 45 at a position near upper ends of the supports 45. The fan module 49 constitutes portions of a front face, the rear face, the left side face, and the right side face of the outdoor unit casing 40, the portions being located above the supports 45, and a top face of the outdoor unit casing 40. The fan module 49 includes the outdoor fan 18 and a bell mouth 491 (see FIG. 7). More specifically, the fan module 49 is an aggregate of the outdoor fan 18 and bell mouth 491 housed in substantially a parallelepiped box whose upper and lower faces are opened. In the fan module 49, the outdoor fan 18 is disposed such that its axis extends vertically. The fan module 49 has an opened upper face portion that functions as a blow-out port 402 through which an outdoor air flow AF is blown out of the outdoor unit casing 40. A grid-shaped grille 492 is disposed on the blow-out port 402.

Figure 5:
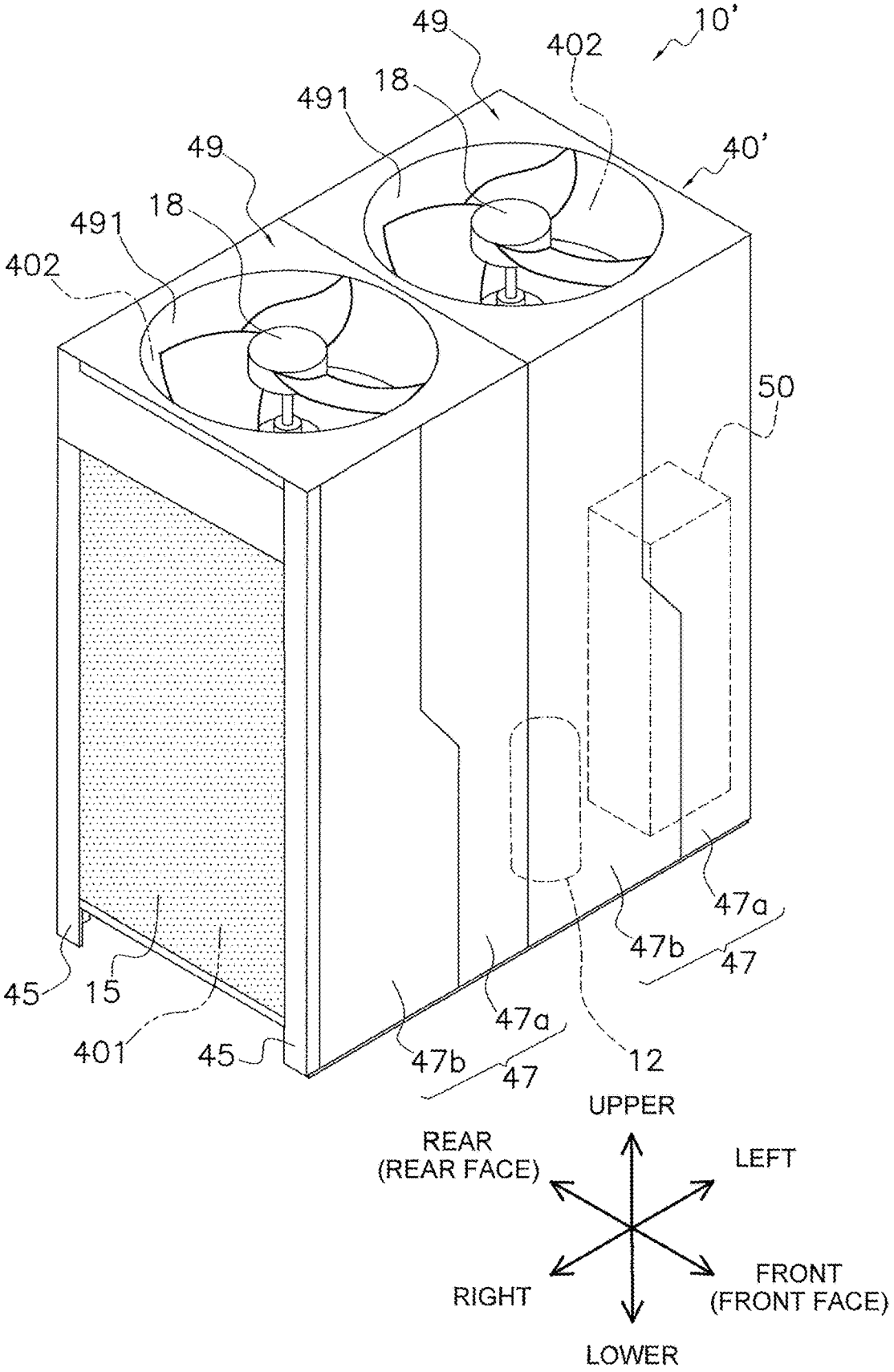
FIG. 5 is a perspective view of an exemplary outdoor unit including two fan modules.

As illustrated in FIGS. 2 to 4, the outdoor unit 10 includes one fan module 49. Alternatively, the outdoor unit 10 may include a plurality of fan modules 49. As illustrated in FIG. 5, for example, an outdoor unit 10' may include two fan modules 49. In the outdoor unit 10' illustrated in FIG. 5, the two fan modules 49 are arranged side by side in the left-right direction. The outdoor unit 10' includes an outdoor unit casing 40' that is larger in dimensions than the outdoor unit casing 40 of the outdoor unit 10 including one fan module 49. The outdoor unit casing 40' includes two front face panels 47 arranged side by side in the left-right direction. Although not illustrated in the drawings, an outdoor heat exchanger 15 of the outdoor unit 10' is larger in dimensions than the outdoor heat exchanger 15 of the outdoor unit 10, in accordance with the dimensions of the outdoor unit casing 40'.

(3-2) Layout of Devices on Bottom Frame 43

Figure 6:
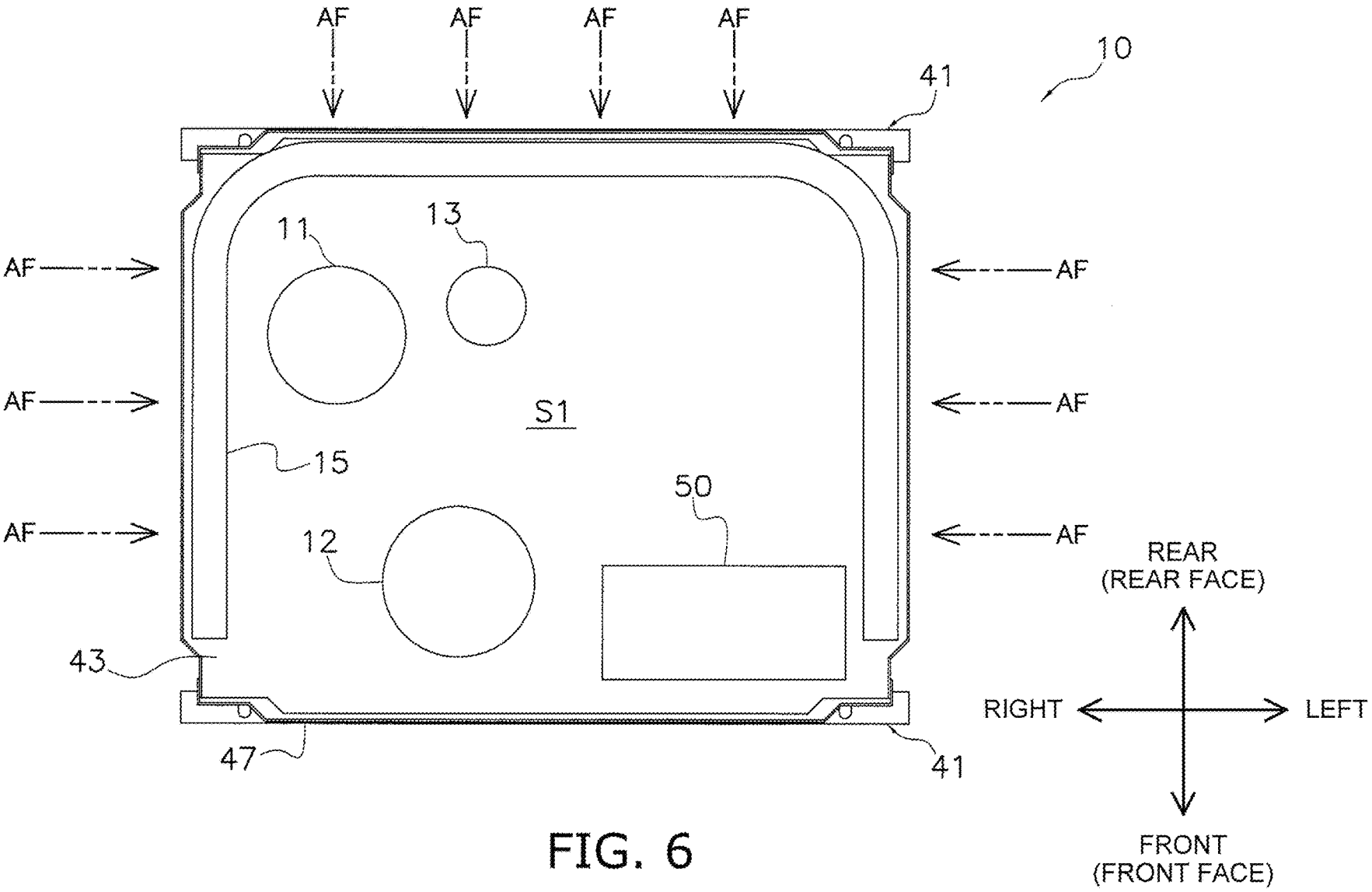
FIG. 6 is a schematic view of a layout of devices on a bottom frame and directions of outdoor air flows.

FIG. 6 is a schematic view of a layout of the devices on the bottom frame 43 and directions of outdoor air flows AF. As illustrated in FIG. 6, various devices, including the accumulator 11, the compressor 12, the oil separator 13, and the outdoor heat exchanger 15, are disposed at predetermined positions on the bottom frame 43. In addition, the electric component box 50 housing therein the outdoor unit control unit 20 is disposed on the bottom frame 43.

The outdoor heat exchanger 15 has heat exchange faces 151 (see FIG. 4) respectively extending along the left side face, right side face, and rear face of the outdoor unit casing 40. The heat exchange faces 151 are substantially equal in height to the intake ports 401. The intake ports 401 mostly occupy the rear face, left side face, and right side face of the outdoor unit casing 40. The heat exchange faces 151 of the outdoor heat exchanger 15 are respectively exposed from the intake ports 401. In other words, the rear face, left side face, and right side face of the outdoor unit casing 40 are substantially formed of the heat exchange faces 151 of the outdoor heat exchanger 15. The outdoor heat exchanger 15 has three heat exchange faces 151. In this regard, the outdoor heat exchanger 15 has left and right curved portions in plan view. In other words, the outdoor heat exchanger 15 has substantially a U shape opened toward the front face.

The accumulator 11 is disposed on a left forward side of the right curved portion of the outdoor heat exchanger 15 and a right rearward side of the compressor 12.

The compressor 12 is disposed on a left side of a right-side end of the outdoor heat exchanger 15 and a left forward side of the accumulator 11. The compressor 12 is located on the right side of the front face portion of the outdoor unit casing 40. The compressor 12 is located below the fan module 49 (the outdoor fan 18). In other words, the outdoor fan 18 is higher in heightwise position than the compressor 12.

The oil separator 13 is disposed on a left side of the accumulator 11.

Figure 7:
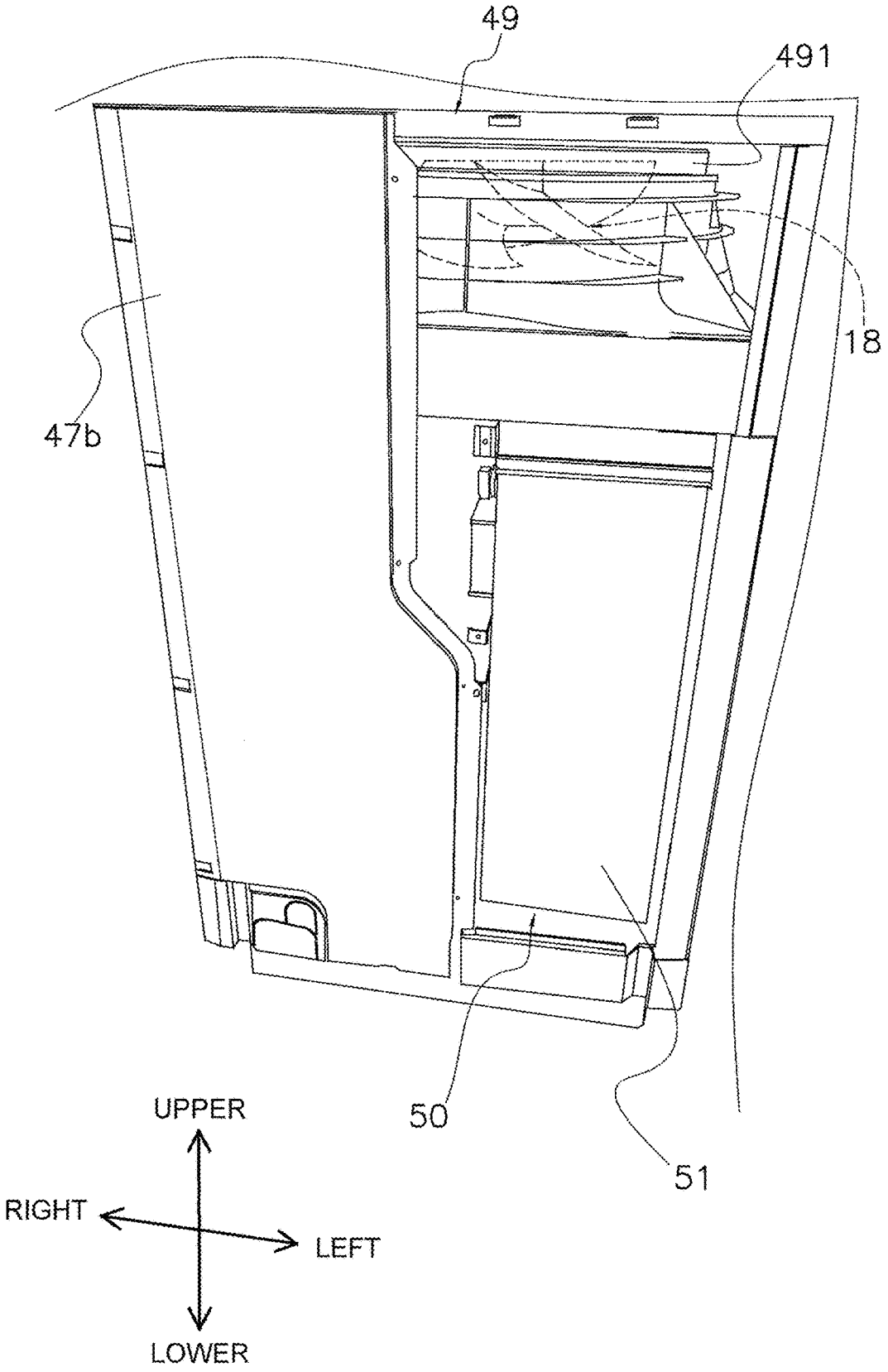
FIG. 7 is a front enlarged view of the outdoor unit from which a first front face panel is detached.

As illustrated in FIGS. 2 and 4 to 6, the electric component box 50 (which is an example of an "electric component box" in the claims) is disposed on a right side of a left-side end of the outdoor heat exchanger 15 and a left side of the compressor 12. The electric component box 50 is located on the left side of the front face portion of the outdoor unit casing 40. FIG. 7 is a front enlarged view of the outdoor unit 10 from which the first front face panel 47*a* is detached. As illustrated in FIG. 7, the electric component box 50 is exposed from the front face of the outdoor unit 10 in the state in which the first front face panel 47*a* is detached from the outdoor unit 10. The electric component box 50 is thus accessible only by detaching the first front face panel 47*a* without detaching the second front face panel 47*b*. The electric component box 50 includes a front face cover 51 constituting a front face portion of the electric component box 50. A specific description on the electric component box 50 will be given later.

(3-3) Outdoor Air Flows AF in Outdoor Unit Casing 40

Figure 8:
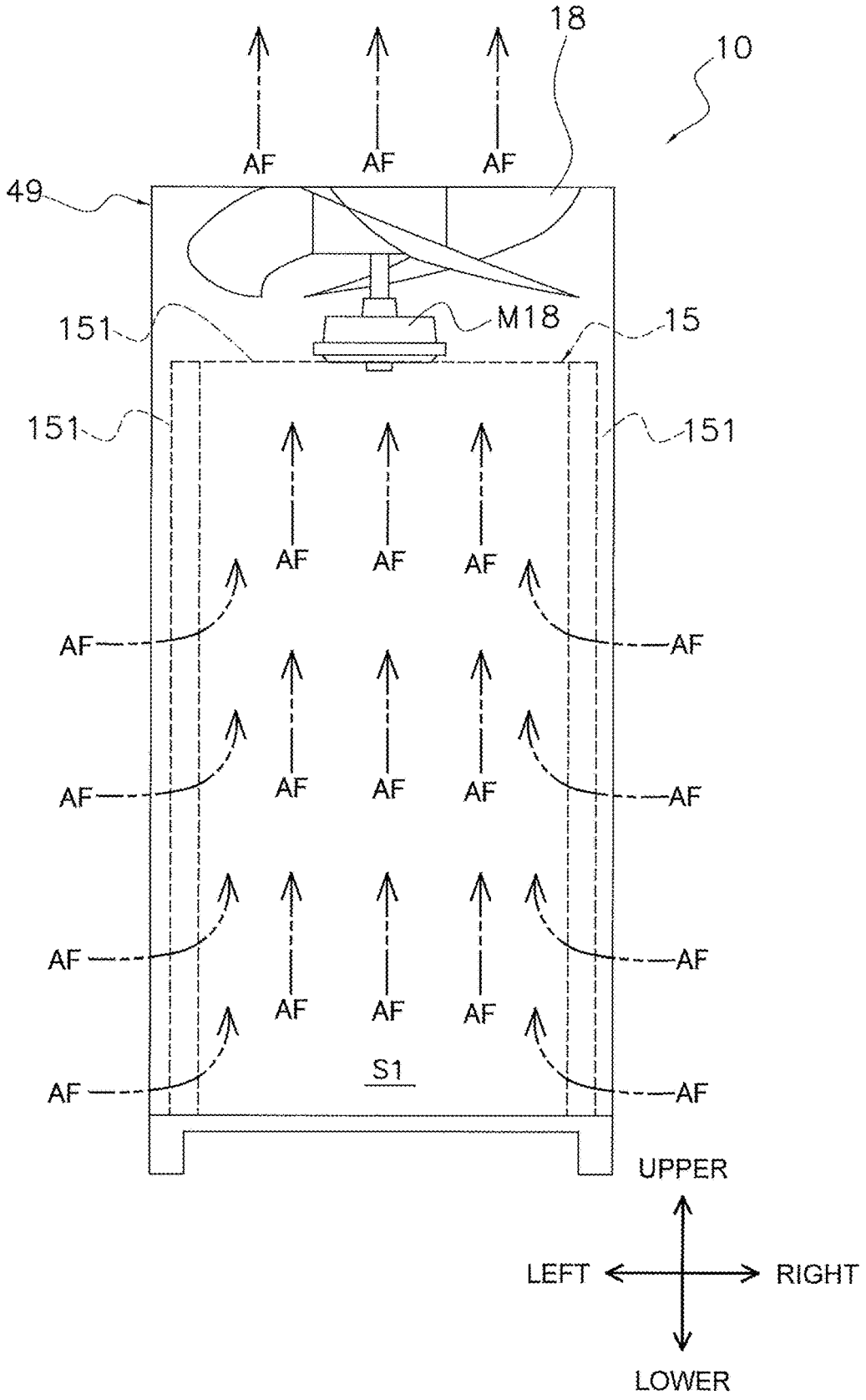
FIG. 8 is a schematic view of outdoor air flows in an outdoor unit casing.

FIG. 8 is a schematic view of outdoor air flows AF in the outdoor unit casing 40. As illustrated in FIGS. 6 and 8, outdoor air flows AF flow into the outdoor unit casing 40 through the intake ports 401 in the left side face, right side face, and rear face of the outdoor unit casing 40, and pass through the outdoor heat exchanger 15 (the heat exchange faces 151). The outdoor air flows AF then mainly flow from below upward to flow out of the outdoor unit casing 40 through the blow-out port 402. Specifically, the outdoor air flows AF flow horizontally into the outdoor unit casing 40 through the intake ports 401, pass through the outdoor heat exchanger 15, turn upward, and flow from below upward toward the blow-out port 402.

In the following description, a space, where main flow paths of outdoor air flows AF are formed, in the outdoor unit casing 40 (a space surrounded with the outdoor heat exchanger 15 and the front face panel 47 in FIG. 6) is referred to as an "air blowing space S1".

(4) Details of Electric Component Box 50

Figure 9:
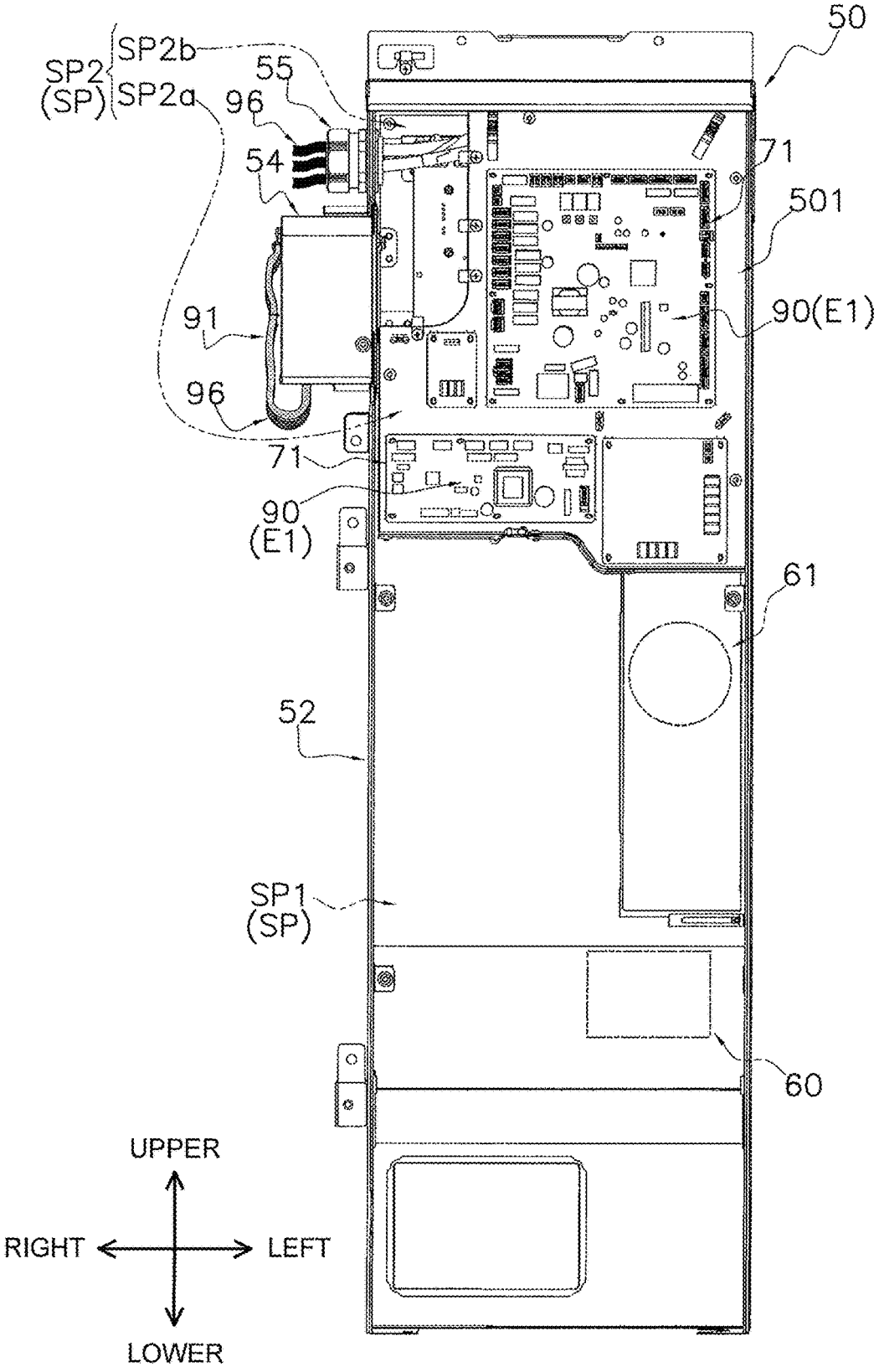
FIG. 9 is a front view of an electric component box from which a front face cover is detached.
Figure 10:
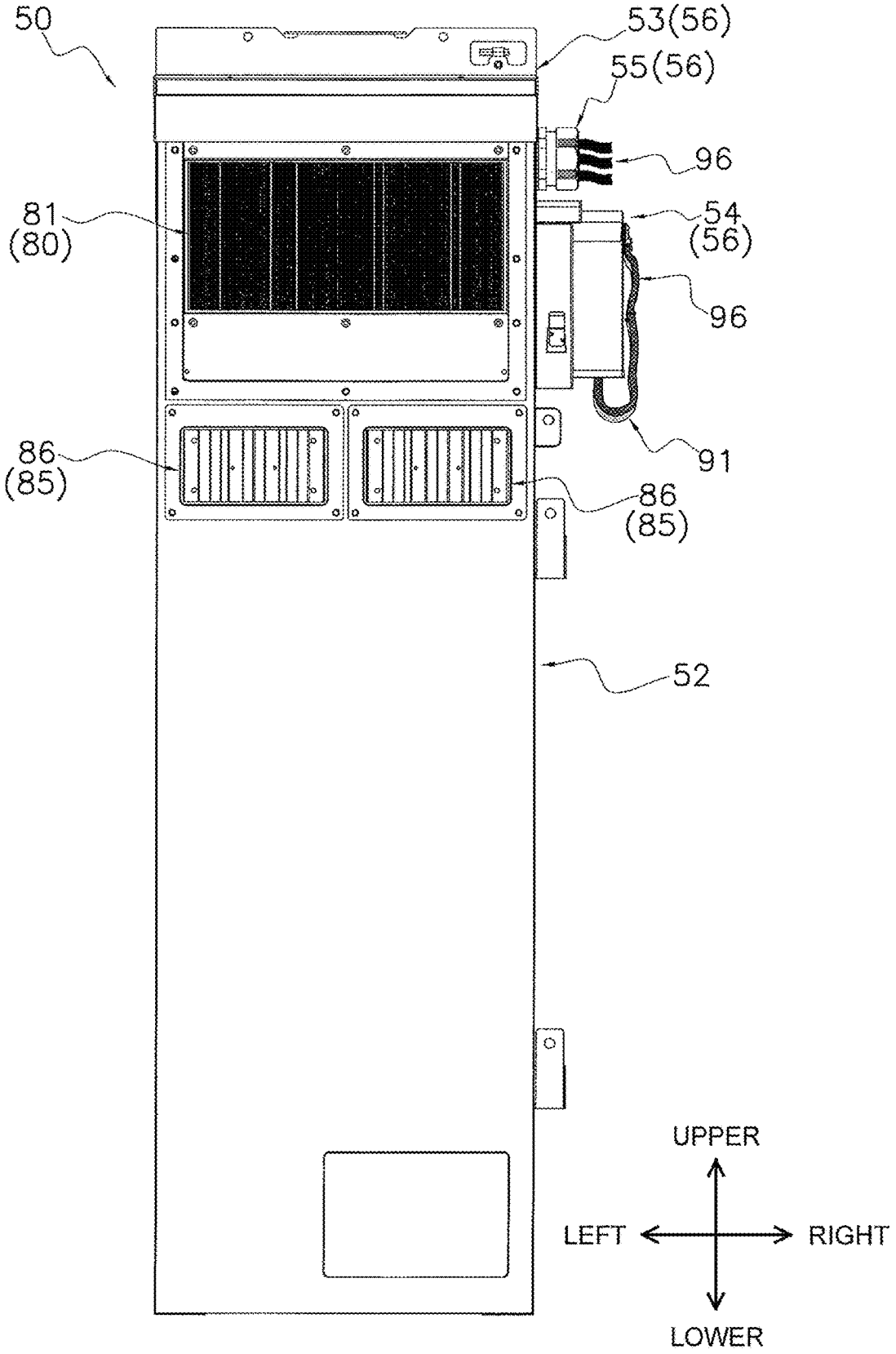
FIG. 10 is a rear view of the electric component box illustrated in FIG. 9.
Figure 11:
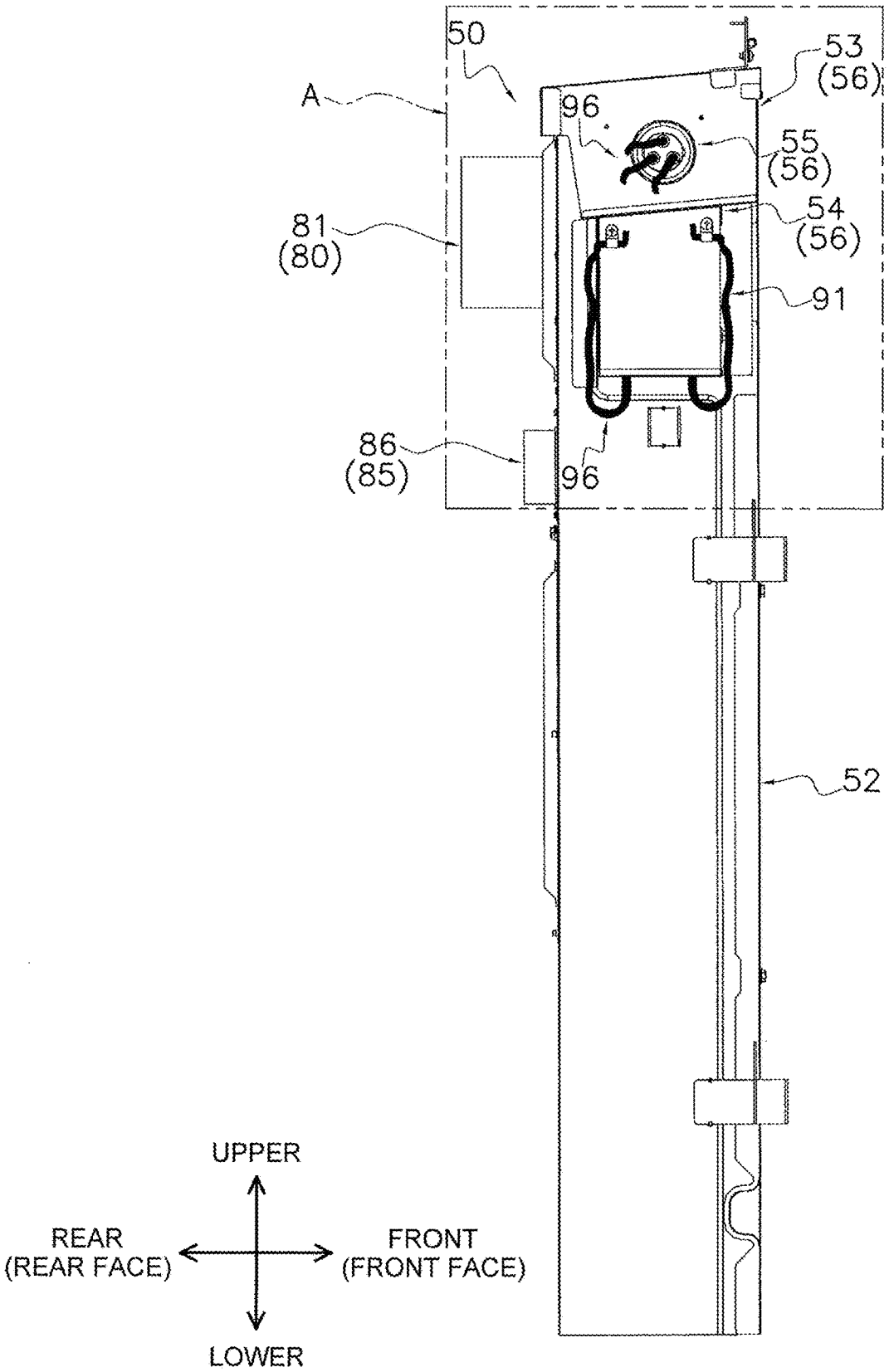
FIG. 11 is a right side view of the electric component box illustrated in FIG. 9.

FIG. 9 is a front view of the electric component box 50 from which the front face cover 51 is detached. FIG. 10 is a rear view of the electric component box 50 illustrated in FIG. 9. FIG. 11 is a right side view of the electric component box 50 illustrated in FIG. 9.

(4-1) Space in Electric Component Box 50 and Layout of Devices in Electric Component Box 50

The electric component box 50 is substantially a parallelepiped box which is made of metal and of which a length in the height direction (the upper-lower direction in one or more embodiments) is longer than a length in the width direction (the left-right direction in one or more embodiments) and a length in the depth direction (the front-rear direction in one or more embodiments). Various electric components E1 (including low-voltage components 90 and high-voltage components 95 to be described later) constituting the outdoor unit control unit 20 are accommodated in a space defined in the electric component box 50 (hereinafter, referred to as an "inner space SP").

The inner space SP includes a lower space SP1 and an upper space SP2 located above the lower space SP1. The lower space SP1 and the upper space SP2 communicate with each other without being separated from each other, and there is no clear boundary between them.

The lower space SP1 extends from a lower end of the inner space SP (a bottom face portion of the electric component box 50) by a predetermined heightwise length (a length that is about substantially two-thirds of a heightwise length of the inner space SP). Electric components E1 such as a terminal block 60 and a reactor 61 are disposed in the lower space SP1.

The upper space SP2 extends from an upper end of the lower space SP1 to an upper end of the inner space SP (a top face portion of the electric component box 50). A vertical plate 501 is disposed in the upper space SP2 to partition the upper space SP2 into two spaces in the depth direction (the front-rear direction). The vertical plate 501 is a metal sheet extending vertically. The vertical plate 501 partitions the upper space SP2 into a front-side upper space SP2*a* and a rear-side upper space SP2*b* located on a rear face side of the front-side upper space SP2*a*. The front-side upper space SP2*a* and the rear-side upper space SP2*b* are arranged in the depth direction of the electric component box 50.

A plurality of (two in one or more embodiments) control boards 71 (each of which is an example of a "board" in the claims) are accommodated in the front-side upper space SP2*a*. On each control board 71, a microcomputer including a CPU, various memories, and the like and electric components E1 such as a communication module are mounted. The control boards 71 are fixed to a front face portion of the vertical plate 501. Each of the control boards 71 is fixed to the vertical plate 501 such that a main surface thereof is directed to the front face (i.e., each control board 71 is thick in the front-rear direction).

Figure 12:
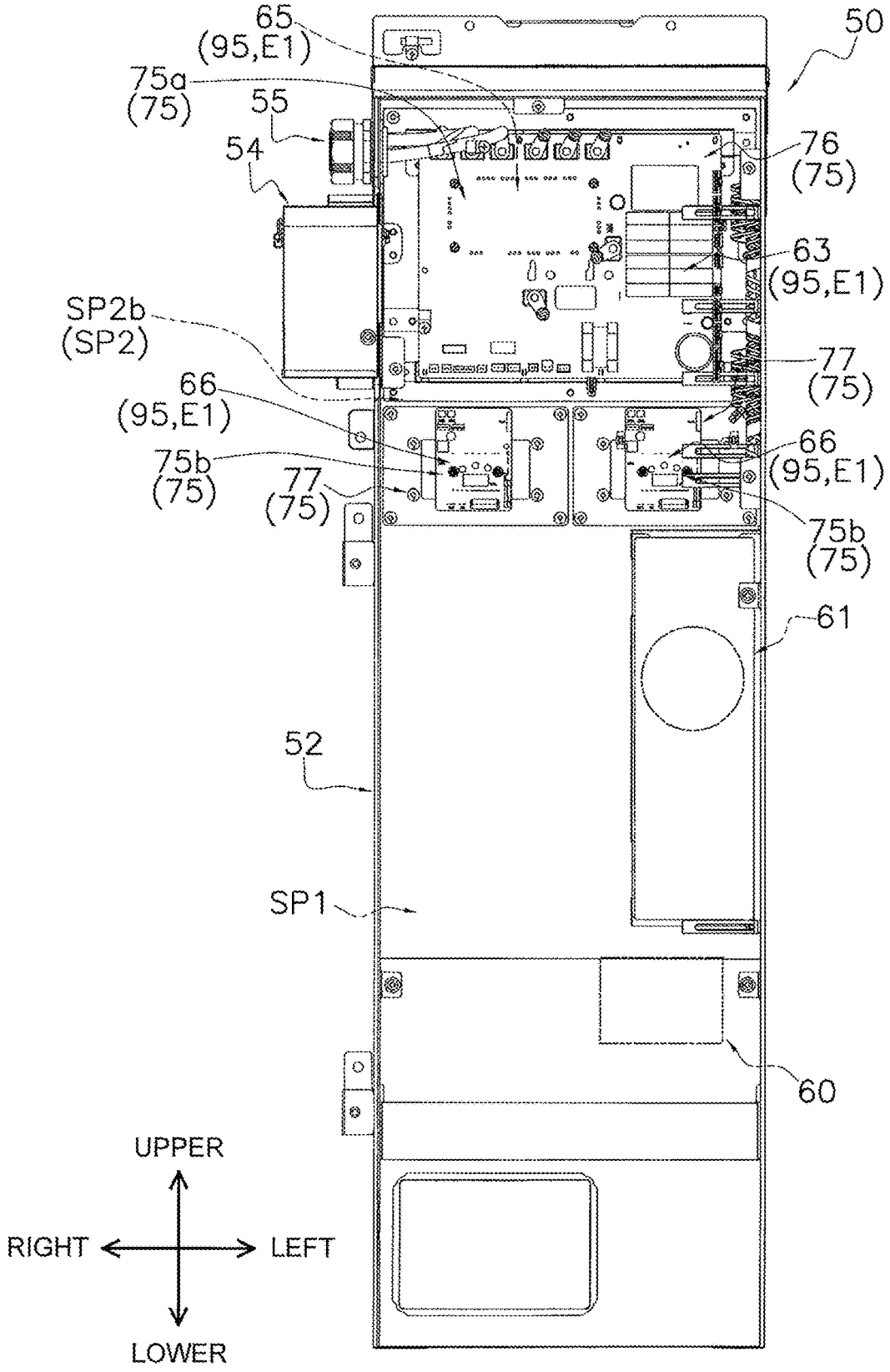
FIG. 12 is a front view of the electric component box from which a vertical plate (a control board) is detached, which does not illustrate part of low-voltage wires and part of high-voltage wires.
Figure 13:
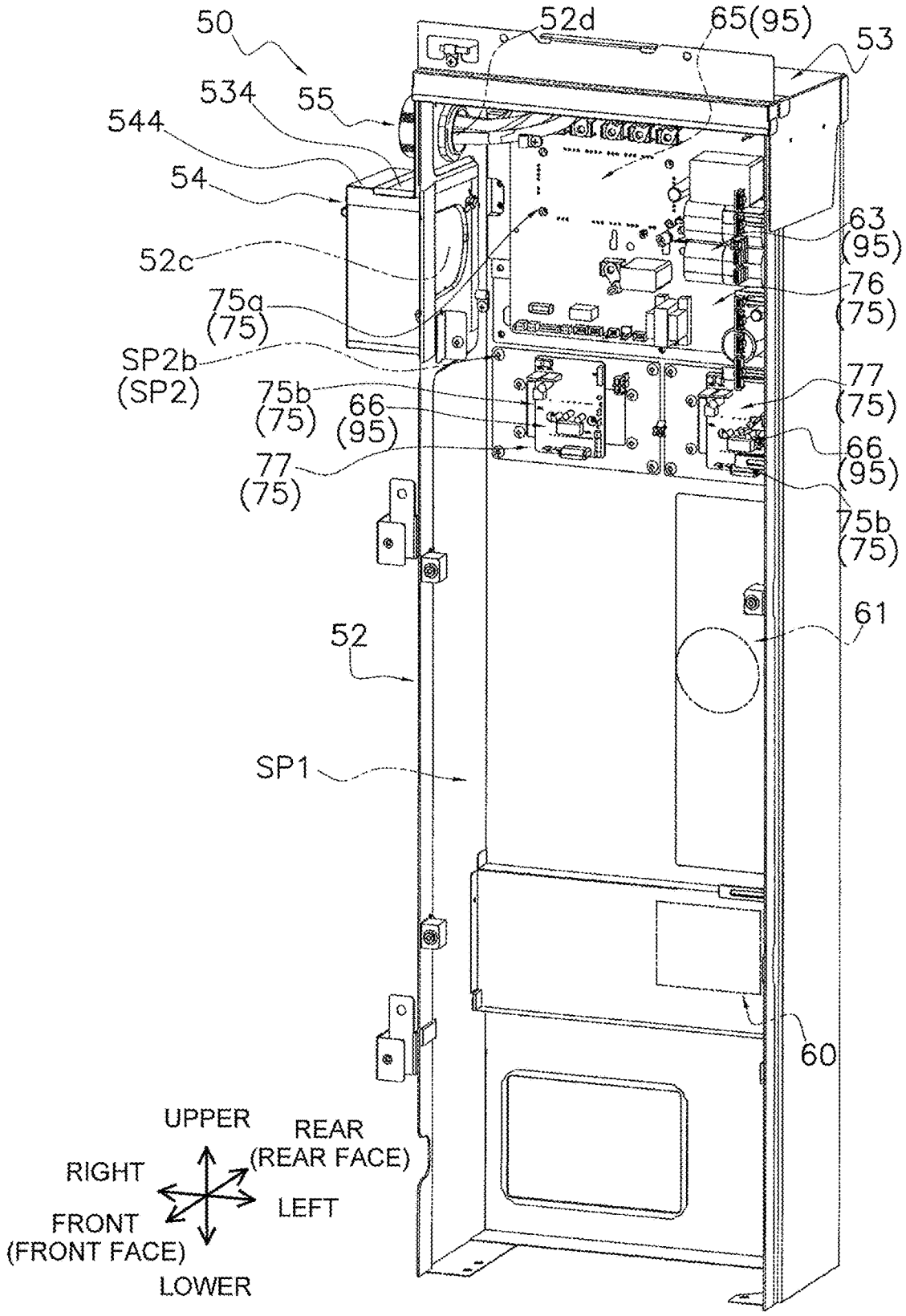
FIG. 13 is a front perspective view of the electric component box illustrated in FIG. 12.

FIG. 12 is a front view of the electric component box 50 from which the vertical plate 501 (each control board 71) is detached, which does not illustrate part of low-voltage wires and part of high-voltage wires. FIG. 13 is a front perspective view of the electric component box 50 illustrated in FIG. 12.

A board unit 75 (which is an example of a "board" in the claims) is accommodated in the rear-side upper space SP2*b*. On the board unit 75, various electric components E1 are mounted for controlling driven states of the actuators disposed in the outdoor unit 10. Specifically, the board unit 75 includes: a compressor controlling electric component mount portion 75*a* on which electric components E1 for inverter-controlling the compressor 12 (hereinafter, referred to as "compressor controlling electric components 63" are mounted; and fan controlling electric component mount portions 75*b* on which electric components E1 for controlling driven states of the outdoor fans 18 (hereinafter, referred to as "fan controlling electric components 66") are mounted.

According to one or more embodiments, the compressor controlling electric components 63 are mounted on a compressor control board 76 that is a part of the board unit 75. According to one or more embodiments, in other words, the compressor controlling electric component mount portion 75*a* is disposed on the compressor control board 76. In addition, the fan controlling electric components 66 are mounted on fan control boards 77 each of which is a part of the board unit 75. According to one or more embodiments, in other words, the fan controlling electric component mount portions 75*b* are respectively disposed on the fan control boards 77.

Examples of the compressor controlling electric components 63 include a smoothing capacitor, a diode bridge, and the like to be mounted on a front-side main surface of the compressor control board 76. Examples of the compressor controlling electric components 63 also include various electric components E1 (e.g., power devices including a switching element, such as an insulated gate bipolar transistor (IGBT)) constituting an inverter. More specifically, a power module 65 including a plurality of (six in one or more embodiments) integrated power devices is mounted on the compressor control board 76 (the compressor controlling electric component mount portion 75*a*). The power module 65 is mounted on a rear-side main surface of the compressor control board 76. The power module 65 is particularly larger in heating value upon energization than the other electric components E1. The power module 65 is, for example, an intelligent power module (IPM) including a plurality of power devices. The power module 65 is higher in heightwise position than the fan controlling electric components 66.

Examples of the fan controlling electric components 66 include a capacitor, a diode, and a switch such as a relay. In FIGS. 12 and 13, on the assumption that the outdoor unit 10 includes two outdoor fans 18 (e.g., the outdoor unit 10' illustrated in FIG. 5), two fan control boards 77 (two fan controlling electric component mount portions 75*b*) are arranged side by side in the left-right direction in the rear-side upper space SP2*b* in one-to-one correspondence with the outdoor fans 18.

In the rear-side upper space SP2*b*, a first cooling unit 80 for cooling the compressor controlling electric components 63 (mainly, the power module 65) mounted on the compressor control board 76 is disposed on a rear face side of the compressor control board 76. The first cooling unit 80 is thermally connected to the power module 65 in an installed state. The first cooling unit 80 includes a plurality of first cooling unit fins 81 for heat exchange with outdoor air flows AF. The first cooling unit fins 81 are located on flow paths of outdoor air flows AF in the installed state.

Also in the rear-side upper space SP2*b*, second cooling units 85 are disposed for cooling the fan controlling electric components 66 mounted on the fan control boards 77. More specifically, the second cooling units 85 disposed in the rear-side upper space SP2*b* are equal in number (two in one or more embodiments) to the fan control boards 77. The second cooling units 85 are in one-to-one correspondence with the fan control boards 77. Each of the second cooling units 85 is disposed on a rear face side of the corresponding fan control board 77. The second cooling units 85 are thermally connected to the fan controlling electric components 66 in the installed state. Each of the second cooling units 85 includes a plurality of second cooling unit fins 86 for heat exchange with outdoor air flows AF. The second cooling unit fins 86 are located on flow paths of outdoor air flows AF in the installed state.

In the following description, the electric components E1 mounted on each control board 71 are referred to as "low-voltage components 90" (each of which is an example of a "second electric component" in the claims), and the electric components E1 mounted on the board unit 75 are referred to as "high-voltage components 95" (each of which is an example of a "first electric component" in the claims).

A plurality of electric wires is drawn into the electric component box 50. The electric wires drawn into the electric component box 50 include, for example, wires connecting the low-voltage components 90 to the devices (e.g., the outdoor-side sensors 19) corresponding to the low-voltage components 90 (hereinafter, such wires are referred to as "low-voltage wires 91"). The electric wires drawn into the electric component box 50 also include, for example, wires connecting the high-voltage components 95 to the devices (e.g., the compressor 12, the outdoor fans 18) corresponding to the high-voltage components 95 (hereinafter, such wires are referred to as "high-voltage wires 96").

Each low-voltage wire 91 (which is an example of a "second wire" in the claims) is a wire mainly for sending a control signal to be exchanged between devices (e.g., a sensor, a microcomputer). Each low-voltage wire 91 carries a voltage (or a current related to the voltage) between the low-voltage component 90 and the device corresponding to the low-voltage component 90.

Each high-voltage wire 96 (which is an example of a "first wire" in the claims) is a wire mainly for supplying electric power as operating energy for a device (e.g., an actuator such as a motor, a heater). Each high-voltage wire 96 carries a voltage (or a current related to the voltage) between the high-voltage component 95 and the device corresponding to the high-voltage component 95.

The voltage and current to be fed to each low-voltage wire 91 are smaller in value than the voltage and current to be fed to each high-voltage wire 96. As to each low-voltage wire 91 and each high-voltage wire 96, the voltage values and current values are appropriately selected in accordance with design specifications and installation environments. In one or more embodiments, each low-voltage wire 91 carries a voltage that is equal to or less than 15 V (or a current related to the voltage), and each high-voltage wire 96 carries a voltage that is equal to or more than 50 V (or a current related to the voltage).

(4-2) Configuration of Electric Component Box 50

Figure 14:
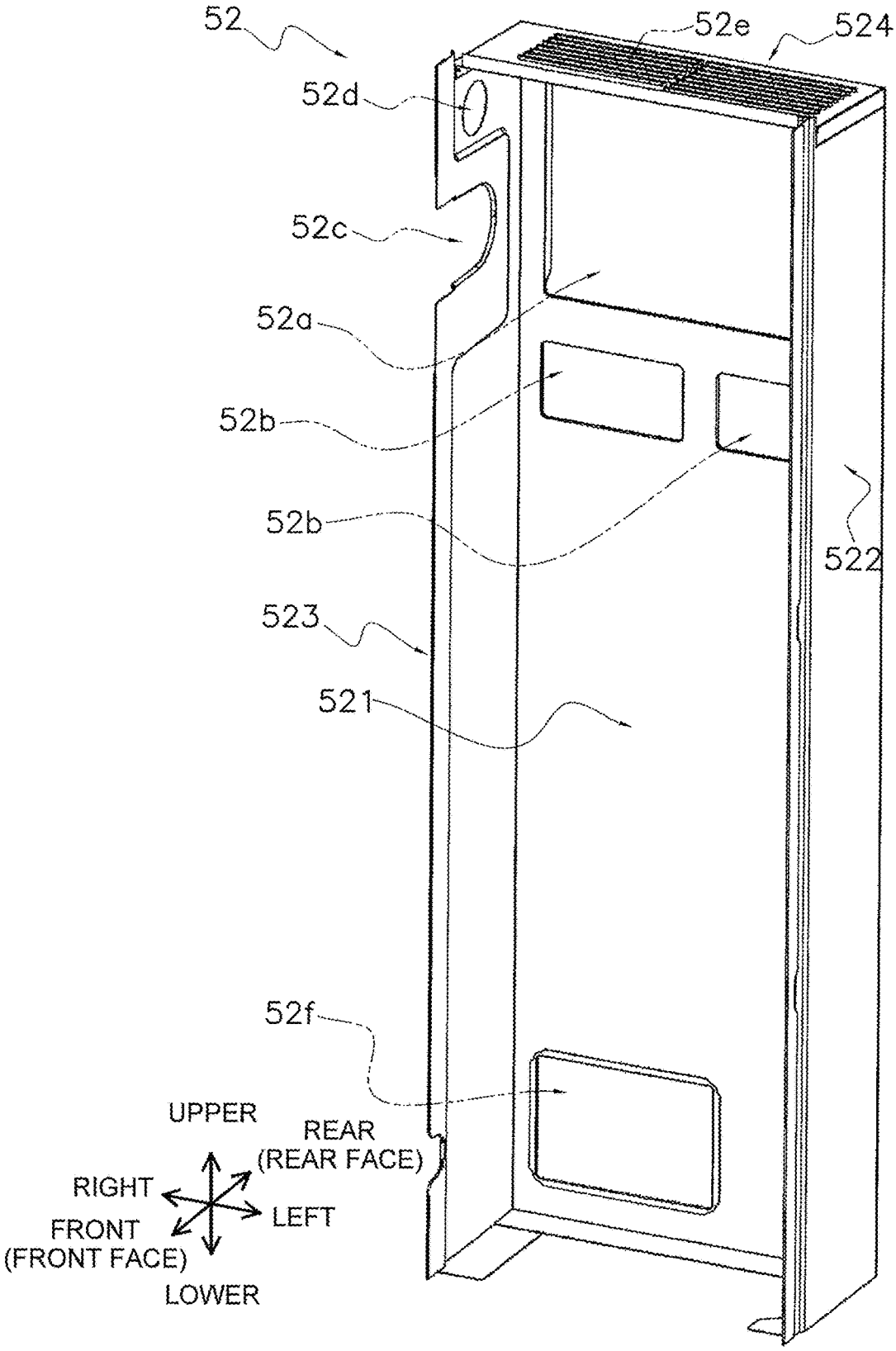
FIG. 14 is a front perspective view of a main body frame.
Figure 15:
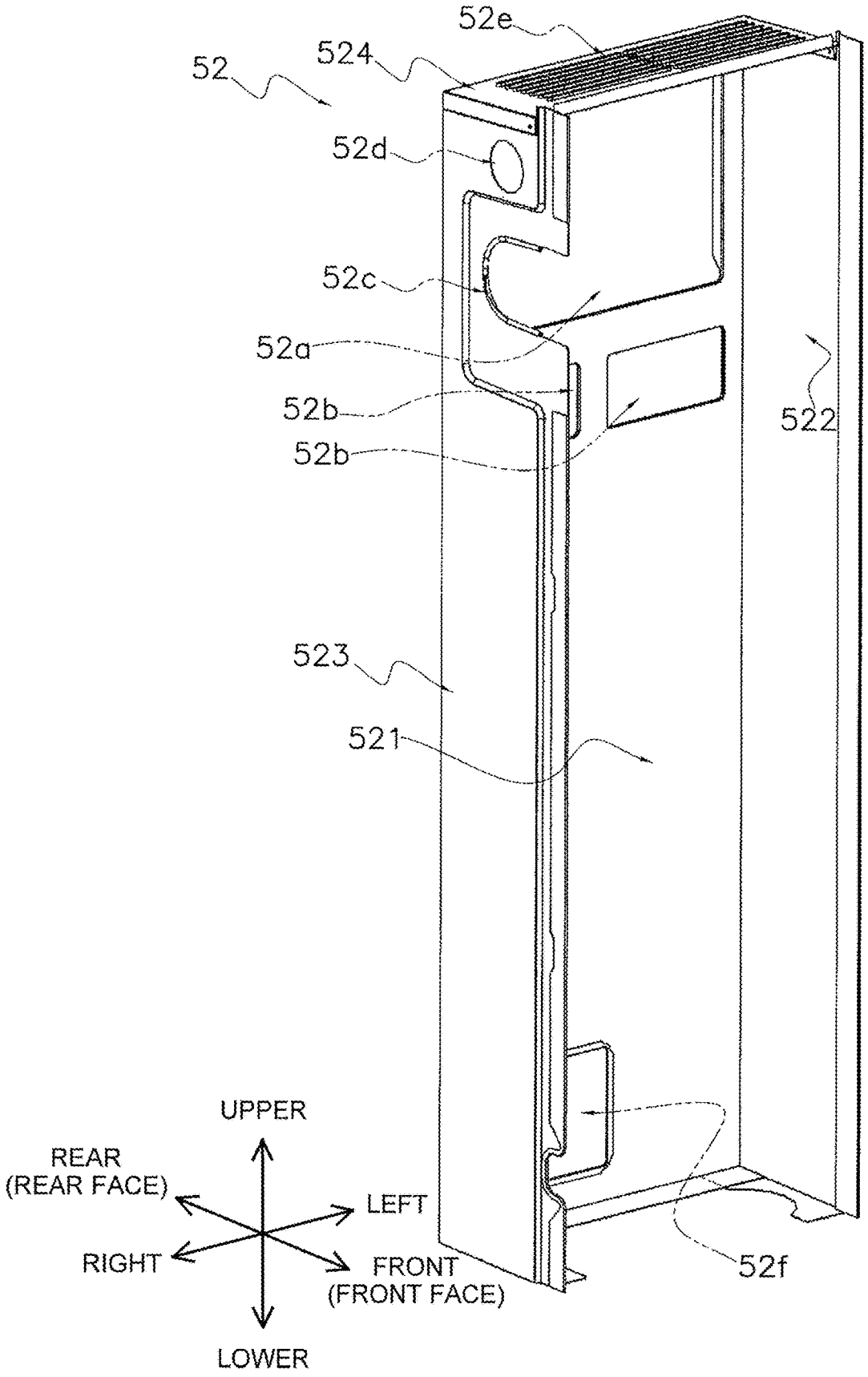
FIG. 15 is a front perspective view of the main body frame seen from an angle different from that in FIG. 14.

The electric component box 50 includes as its constituent members the front face cover 51 (see FIG. 7) and a main body frame 52 (see FIGS. 14 and 15).

(4-2-1) Front Face Cover 51

The front face cover 51 is substantially a rectangular plate-shaped member constituting a front face portion of the electric component box 50. The front face cover 51 is substantially equal in widthwise length and heightwise length to the electric component box 50.

(4-2-2) Main Body Frame 52

Figure 16:
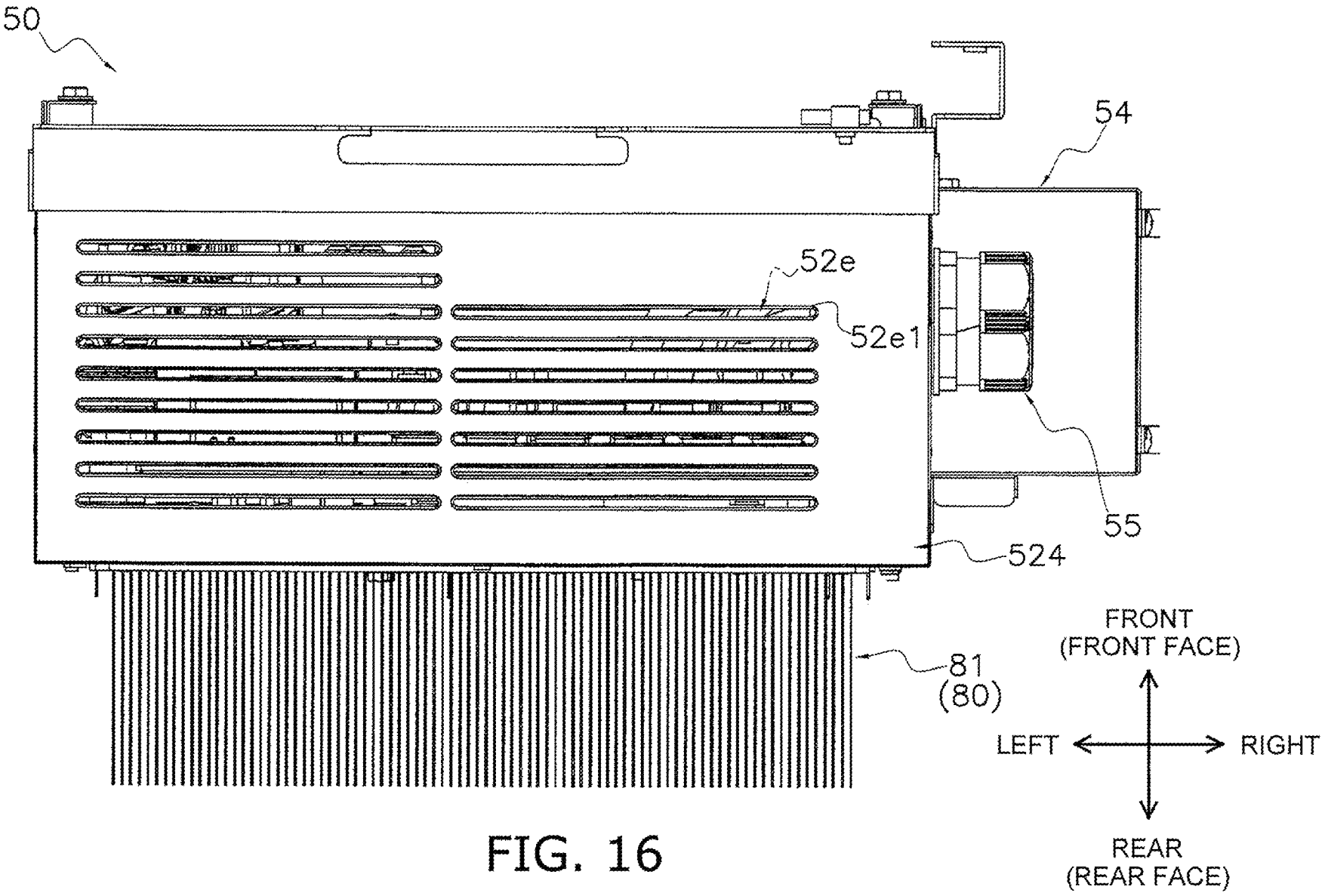
FIG. 16 is a top view of the electric component box from which a top face cover is detached.

FIG. 14 is a front perspective view of the main body frame 52. FIG. 15 is a front perspective view of the main body frame 52 seen from an angle different from that in FIG. 14. FIG. 16 is a top view of the electric component box 50 from which the top face cover 53 is detached.

The main body frame 52 is a housing that is made of metal and constitutes a main body portion of the electric component box 50. The main body frame 52 includes: a rear face part 521 constituting a rear face portion of the electric component box 50; a left side face part 522 constituting a left side face portion of the electric component box 50; a right side face part 523 constituting a right side face portion of the electric component box 50; and a top face part 524 constituting the top face portion of the electric component box 50.

The rear face part 521 has substantially a rectangular shape, and is substantially equal in dimensions to the front face cover 51. The left side face part 522 has substantially a rectangular shape, and extends forward from a left-side end of the rear face part 521. The right side face part 523 has substantially a rectangular shape, and extends forward from a right-side end of the rear face part 521. The top face part 524 has substantially a rectangular shape, and is connected to an upper end portion of the rear face part 521, an upper end portion of the left side face part 522, and an upper end portion of the right side face part 523. Each of the rear face part 521, the left side face part 522, and the right side face part 523 has a lower end portion bent horizontally and elongated along the bottom frame 43 such that the main body frame 52 is disposed upright on the bottom frame 43 of the outdoor unit casing 40.

The main body frame 52 (the rear face part 521) has a plurality of holes. Specifically, the main body frame 52 has a first hole 52*a* from which the heat radiating fins (the first cooling unit fins 81) of the first cooling unit 80 are exposed to the air blowing space S1. The first hole 52*a* is formed at a position corresponding to a position at which the first cooling unit 80 and compressor control board 76 are disposed.

The main body frame 52 (the rear face part 521) also has second holes 52*b* from which the heat radiating fins (the second cooling unit fins 86) of the second cooling units 85 are exposed to the air blowing space S1. The second holes 52*b* are equal in number (two in one or more embodiments) to the second cooling units 85. The second holes 52*b* are in one-to-one correspondence with the second cooling units 85. The heat radiating fins of the second cooling units 85 are respectively exposed from the second holes 52*b*. Each of the second holes 52*b* is located below the first hole 52*a*, and is formed at a position corresponding to a position where the corresponding second cooling unit 85 and fan control board 77 are disposed.

The main body frame 52 (the right side face part 523) also has a third hole 52*c* (which is an example of a "wire through-hole" in the claims) through which the low-voltage wires 91 and the high-voltage wires 96 are drawn into the electric component box 50. The third hole 52*c* is formed at a position corresponding to the upper space SP2, by cutting a part of the right side face part 523 into substantially a U shape or substantially a C shape. According to one or more embodiments, the third hole 52*c* is lower in heightwise position than an upper end of the board unit 75 (more specifically, the compressor control board 76) and higher in heightwise position than a lower end of the board unit 75. A description on the details of the third hole 52*c* and the drawn states of the wires will be given later.

The main body frame 52 (the right side face part 523) also has a fourth hole 52*d* through which the high-voltage wires 96 (particularly, power wires connected to the compressor 12) are drawn into the electric component box 50. The fourth hole 52*d* is located above the third hole 52*c*, and is formed by punching a part of the right side face part 523 into substantially an O shape. According to one or more embodiments, the high-voltage wires 96 drawn into the electric component box 50 through the fourth hole 52*d* are three electric wires for feeding a three-phase voltage of 200 V to the compressor 12.

The main body frame 52 (the top face part 524) also has a plurality of fifth holes 52*e* each functioning as an "exhaust port" through which air is discharged from the electric component box 50. According to one or more embodiments, each fifth hole 52*e* is a slit extending in the left-right direction. As illustrated in FIG. 16, in the top face part 524, the fifth holes 52*e* arranged in the depth direction (the front-rear direction) are formed in two rows in the width direction (the left-right direction). In the state in which the electric component box 50 is disposed in the outdoor unit casing 40, the fifth holes 52*e* are lower in heightwise position than the outdoor fans 18 and higher in heightwise position than the heat radiating fins (the first cooling unit fins 81 to be described later) of the first cooling unit 80. As illustrated in FIG. 16, each fifth hole 52*e* is subjected to burring, so that an edge portion (an edge part 52*e*1) of each fifth hole 52*e* extends upward. Such edge parts 52*e*1 suppress the entry of liquid into the inner space SP through the fifth holes 52*e* even when the liquid adheres to an upper face of the top face part 524.

The main body frame 52 (the rear face part 521) also has, near its lower end, a sixth hole 52*f* through which a service engineer accesses the compressor 12 for maintenance and other purposes.

(5) Cover Unit 56

A cover unit 56 (which is an example of a "cover part" in the claims) is disposed on an outer face of the electric component box 50 so as to suppress (i.e., prevent) the entry of liquid into the inner space SP. The cover unit 56 on the electric component box 50 includes: a top face cover 53 configured to suppress the entry of liquid into the inner space SP through the first hole 52*a* and third hole 52*c*; a first side face cover 54 configured to suppress the entry of liquid into the inner space SP through the third hole 52*c* in the right side face part 523; and a second side face cover 55 configured to suppress the entry of liquid into the inner space SP through the fourth hole 52*d*.

(5-1) Top Face Cover 53

Figure 17:
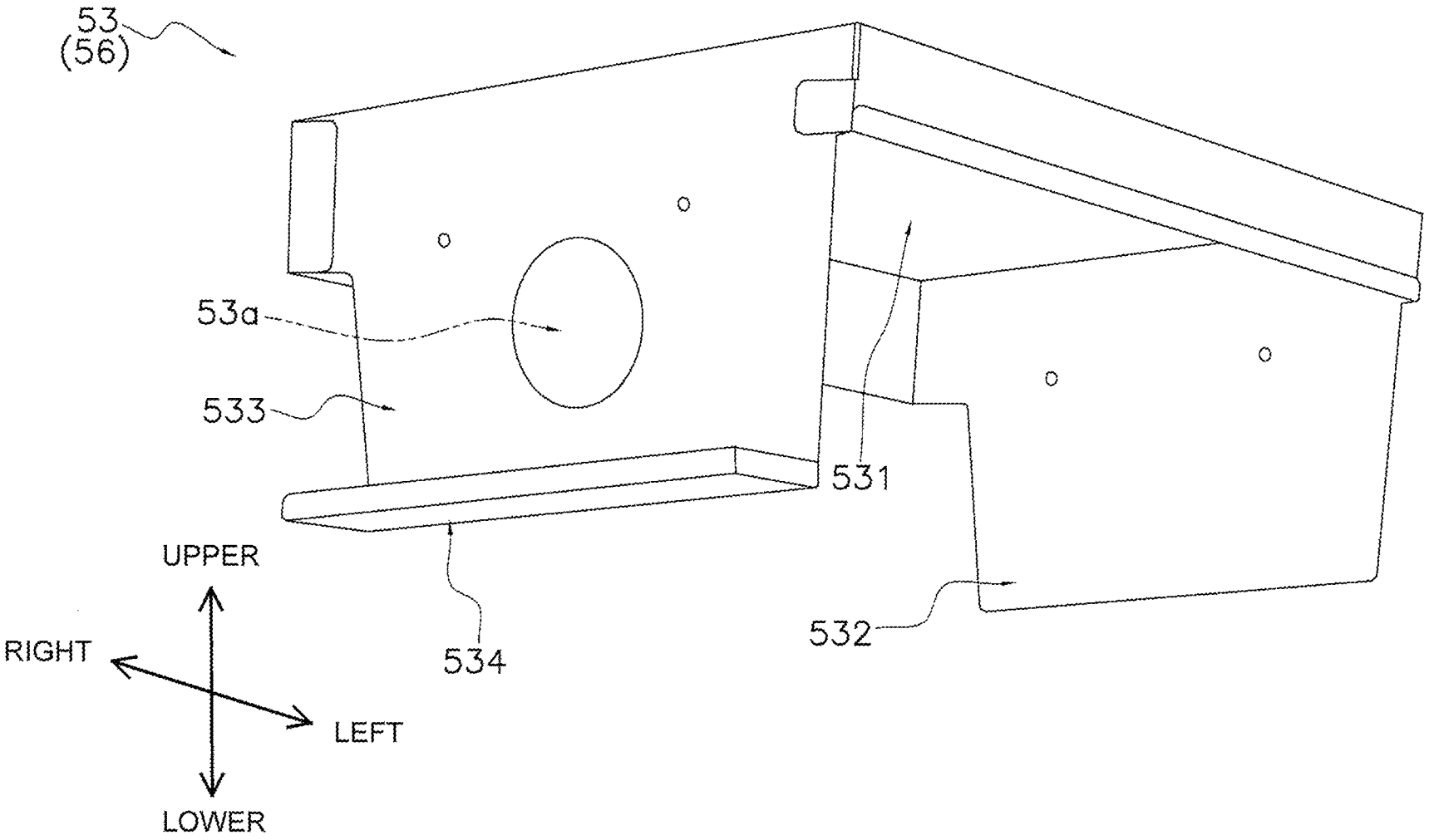
FIG. 17 is a perspective view of the top face cover.
Figure 18:
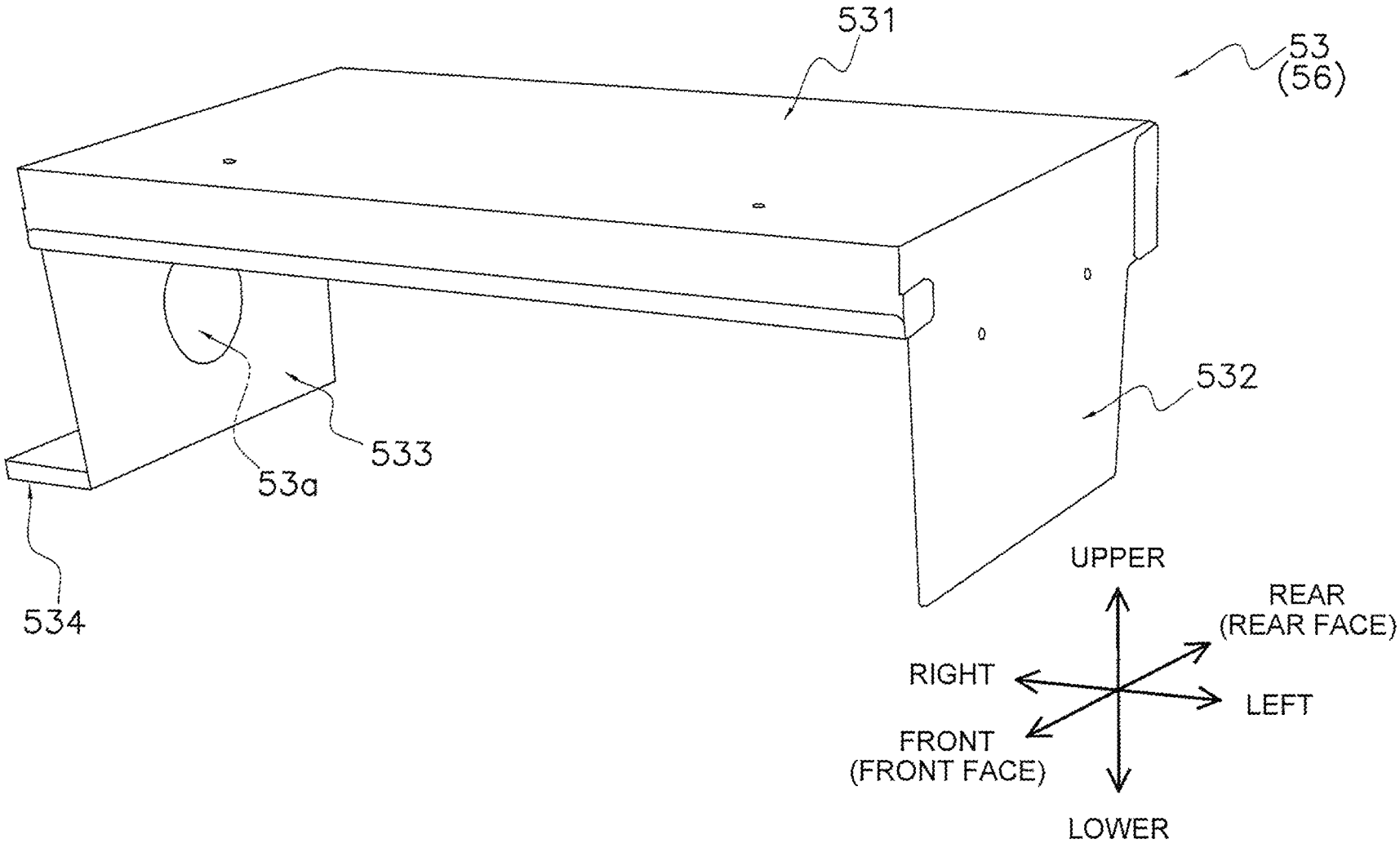
FIG. 18 is a perspective view of the top face cover seen from an angle different from that in FIG. 17.

FIG. 17 is a perspective view of the top face cover 53. FIG. 18 is a perspective view of the top face cover 53 seen from an angle different from that in FIG. 17.

The top face cover 53 (which is an example of a "second cover member" in the claims) is a sheet metal member covering an upper end portion of the main body frame 52 from above so as to suppress the entry of liquid into the inner space SP through the fifth holes 52*e* in the top face part 524 of the electric component box 50. The top face cover 53 is upwardly spaced apart from the fifth holes 52*e*. The top face cover 53 includes an upper cover part 531, a left lateral cover part 532, a right lateral cover part 533, and a flange part 534.

The upper cover part 531 is a portion covering the top face part 524 (the fifth holes 52*e*) of the main body frame 52 from above. The upper cover part 531 has substantially a rectangular shape in plan view, and is larger in area than the top face part 524 of the main body frame 52.

The left lateral cover part 532 externally covers a portion near an upper end of the left side face part 522 of the main body frame 52. The left lateral cover part 532 is a portion extending downward from a left end of the upper cover part 531.

The right lateral cover part 533 externally covers a portion near an upper end of the right side face part 523 of the main body frame 52. The right lateral cover part 533 is a portion extending downward from a right end of the upper cover part 531. The right lateral cover part 533 has an opening 53*a* at a position superimposed on the fourth hole 52*d*.

The flange part 534 is a plate-shaped portion continuously extending rightward from a lower end portion of the right lateral cover part 533. The flange part 534 is located above the third hole 52*c* and the first side face cover 54, and covers the surroundings of the third hole 52*c* and first side face cover 54 from above in conjunction with the right lateral cover part 533. More specifically, the flange part 534 covers a contact portion of the first side face cover 54 with the electric component box 50 (the right side face part 523) from above in conjunction with the right lateral cover part 533. Even when a clearance is formed between the first side face cover 54 and the electric component box 50 (the right side face part 523), this configuration suppresses the entry of liquid into the electric component box 50 through the clearance. As will be described later, the flange part 534 is tilted rearward on a down grade in accordance with a tilt angle of an upper part 544 of the first side face cover 54.

(5-2) First Side Face Cover 54

Figure 19:
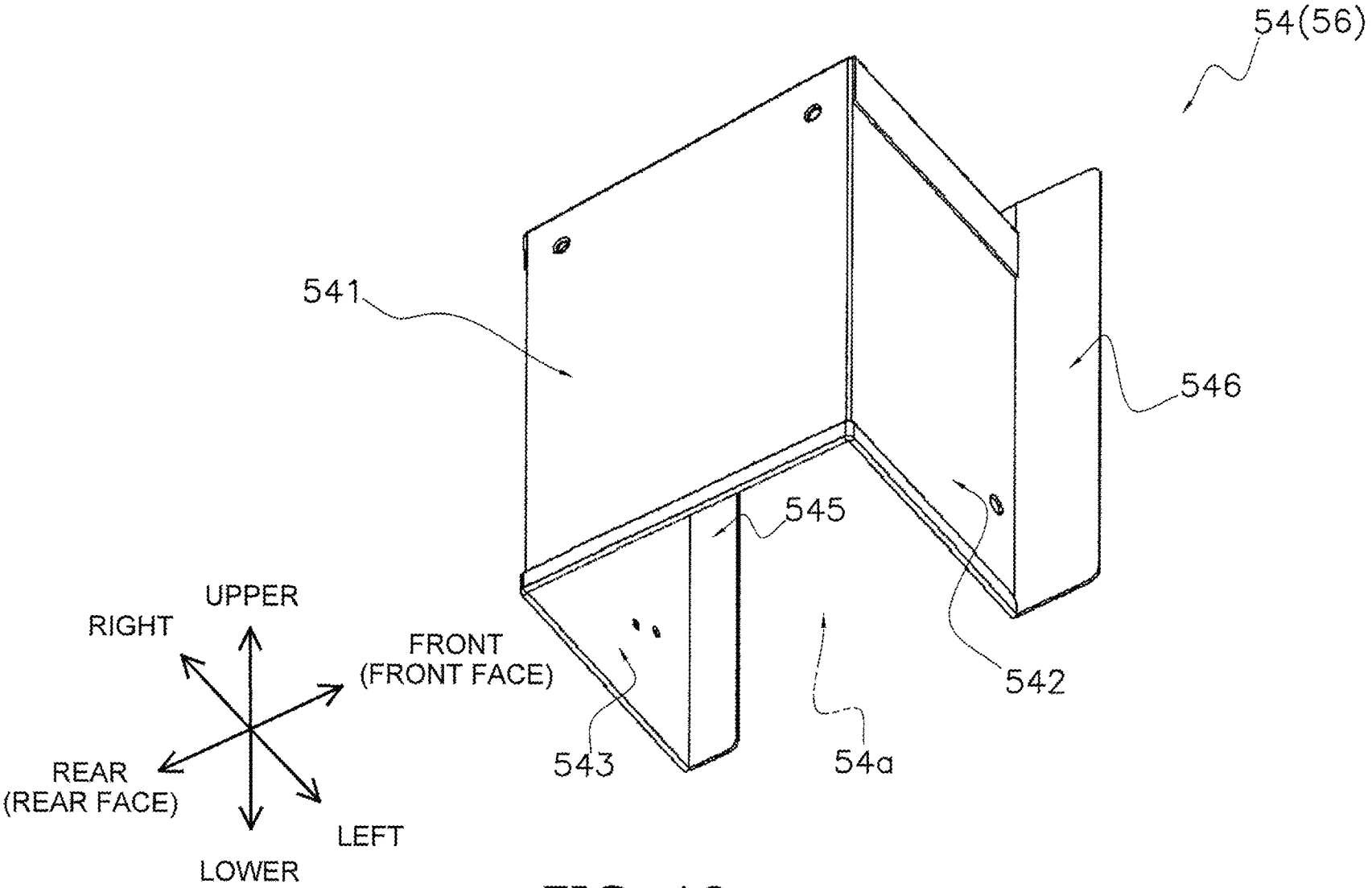
FIG. 19 is a perspective view of a first side face cover.
Figure 20:
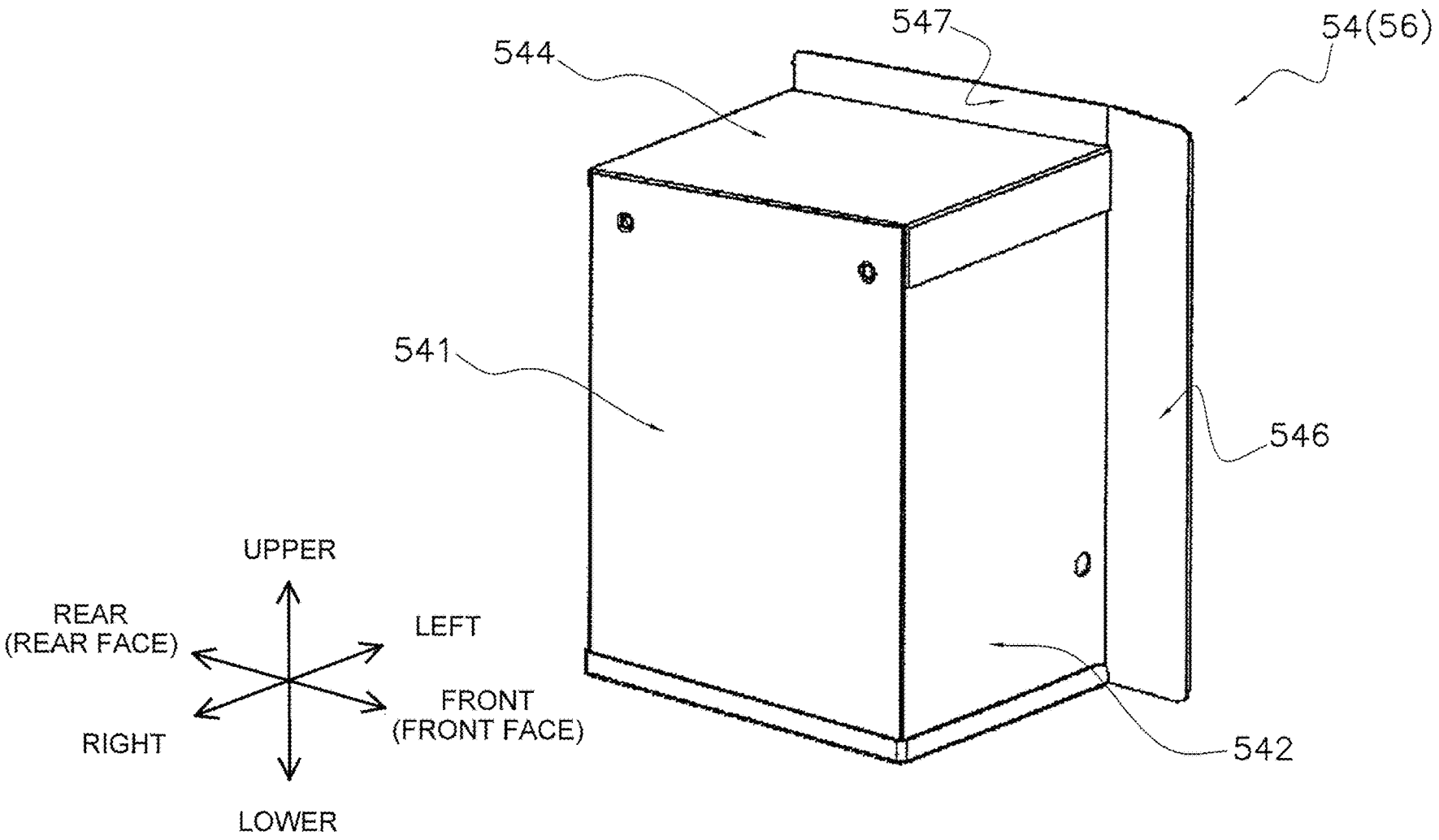
FIG. 20 is a perspective view of the first side face cover seen from an angle different from that in FIG. 19.
Figure 21:
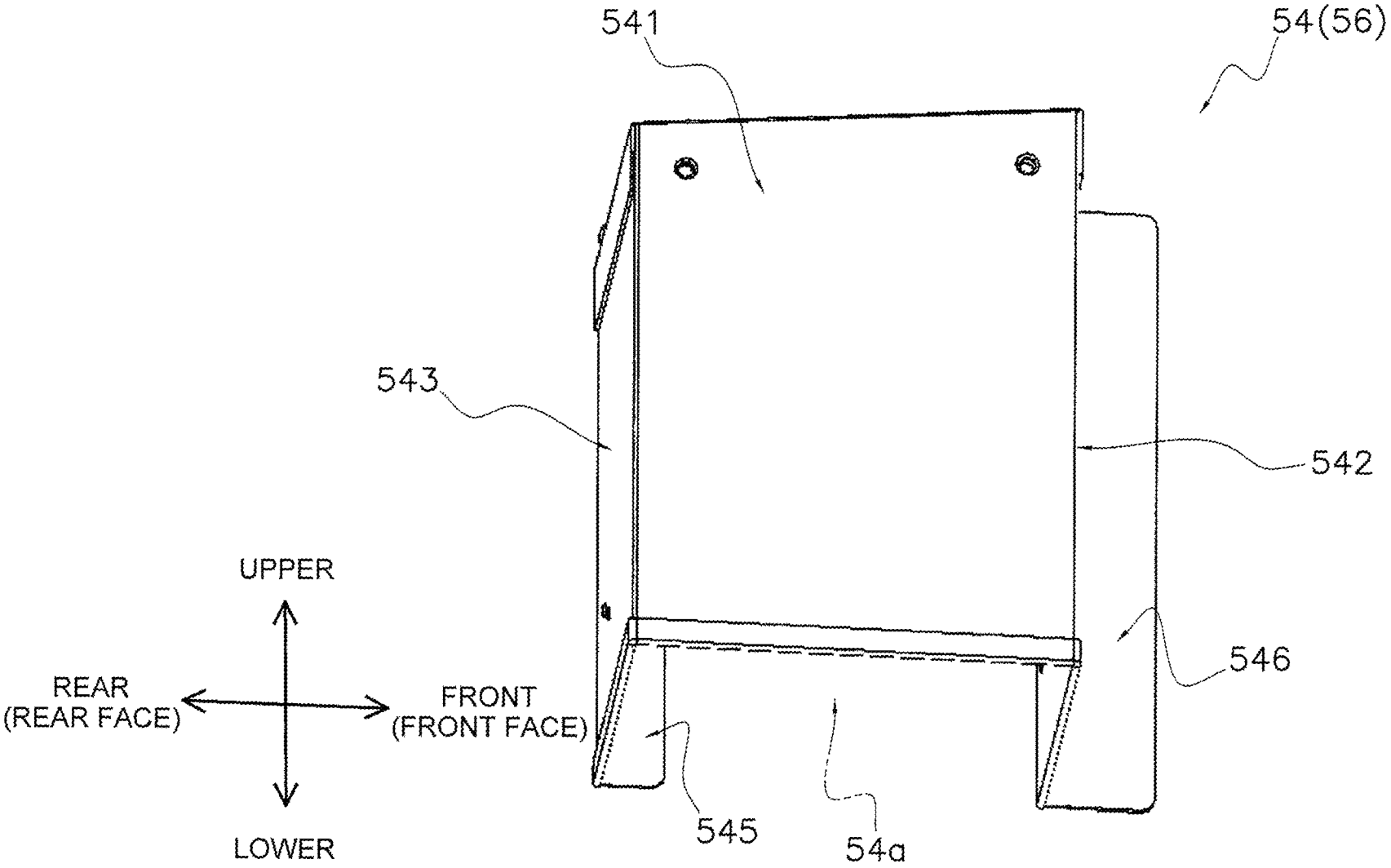
FIG. 21 is a right perspective view of the first side face cover.
Figure 22:
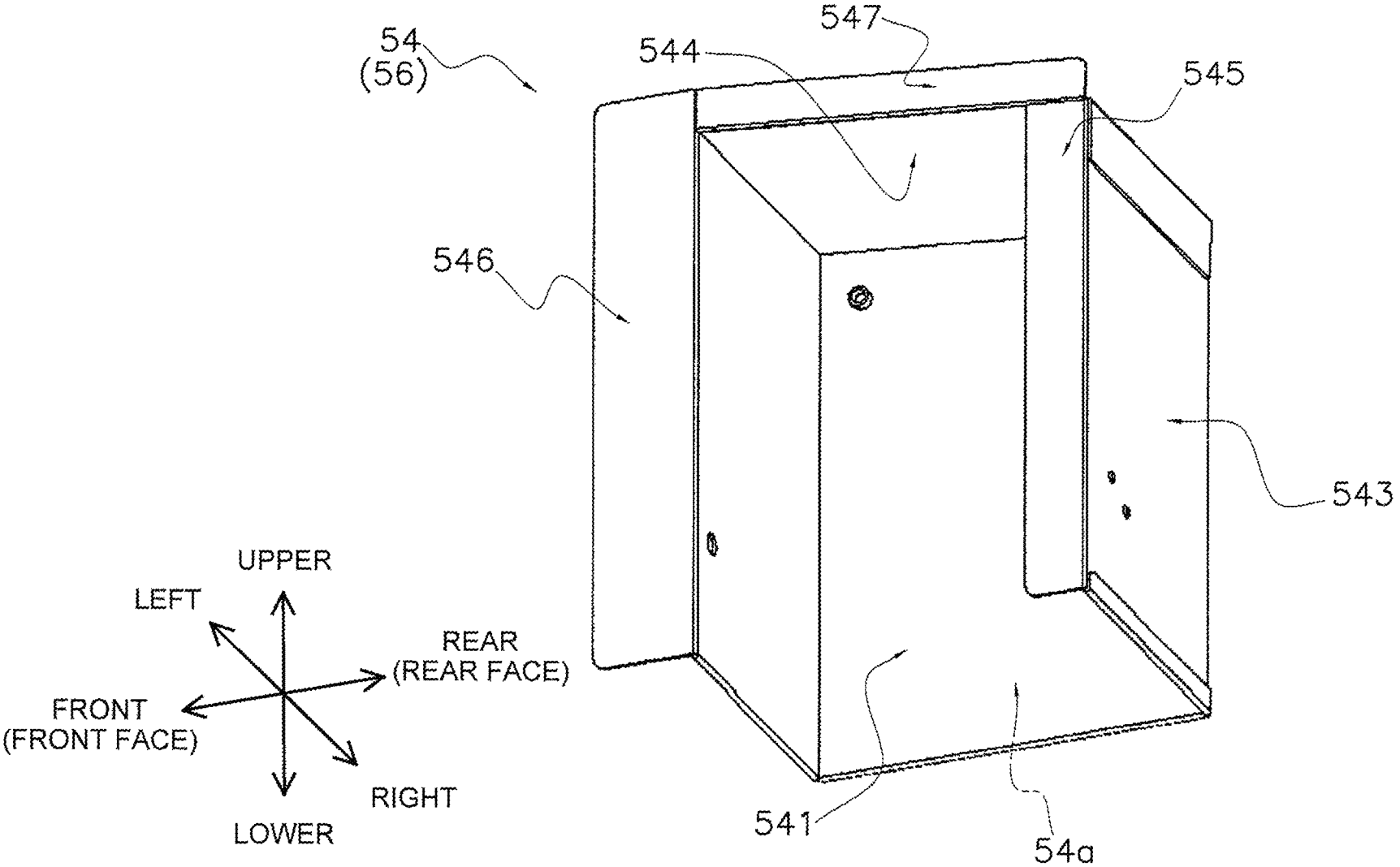
FIG. 22 is a left perspective view of the first side face cover.

FIG. 19 is a perspective view of the first side face cover 54. FIG. 20 is a perspective view of the first side face cover 54 seen from an angle different from that in FIG. 19. FIG. 21 is a right perspective view of the first side face cover 54. FIG. 22 is a left perspective view of the first side face cover 54.

The first side face cover 54 (which is an example of a "first cover member" in the claims) is a sheet metal member disposed along (above and beside) the third hole 52*c* and externally covering the third hole 52*c*, specifically covering the third hole 52*c* from above and from sideward so as to suppress the entry of liquid into the inner space SP through the third hole 52*c* in the right side face part 523 of the main body frame 52. The first side face cover 54 includes a right-side part 541, a front-side part 542, a rear-side part 543, the upper part 544, a rear-side bent part 545, a front-side bent part 546, and an upper-side bent part 547.

The right-side part 541 is a portion covering the third hole 52*c* from a right side of the third hole 52*c*. The right-side part 541 has substantially a rectangular shape.

The front-side part 542 is a portion covering the third hole 52*c* from a front side of the third hole 52*c*. The front-side part 542 has substantially a rectangular shape.

The rear-side part 543 is a portion covering the third hole 52*c* from a rear side of the third hole 52*c*. The rear-side part 543 has substantially a rectangular shape.

The upper part 544 is a portion covering the third hole 52*c* from an upper side of the third hole 52*c*. The upper part 544 has substantially a rectangular shape.

The rear-side bent part 545 is a portion having substantially a rectangular shape and formed by bending a left-side end of the rear-side part 543 at substantially the right angle. The rear-side bent part 545 extends toward the front face from the left-side end of the rear-side part 543. The rear-side bent part 545 is in contact at its left-side main surface with an outer face of the right side face part 523 of the electric component box 50 in the installed state. A seal member 57 (see FIG. 25) is affixed to a left-side face of the rear-side bent part 545 in order to suppress formation of a clearance between the rear-side bent part 545 and the right side face part 523 of the electric component box 50 in the installed state.

The front-side bent part 546 is a portion having substantially a rectangular shape and formed by bending a left-side end of the front-side part 542 at substantially the right angle. The front-side bent part 546 extends toward the front face from the left-side end of the front-side part 542. The front-side bent part 546 is in contact at its left-side main surface with an outer face of the right side face part 523 of the electric component box 50 in the installed state. A seal member 58 (see FIG. 25) is affixed to a left-side face of the front-side bent part 546 in order to suppress formation of a clearance between the front-side bent part 546 and the right side face part 523 of the electric component box 50 in the installed state.

The upper-side bent part 547 is a portion having substantially a rectangular shape and formed by bending a left-side end of the upper part 544 at substantially the right angle. The upper-side bent part 547 extends upward from the left-side end of the upper part 544. The upper-side bent part 547 is in contact at its right-side main surface with an inner face of the right side face part 523 of the electric component box 50 in the installed state. In other words, the upper-side bent part 547 is located in the electric component box 50 (the inner space SP) in the installed state. A seal member (not illustrated) is affixed to a right-side face of the upper-side bent part 547 in order to suppress formation of a clearance between the upper-side bent part 547 and the right side face part 523 of the electric component box 50 in the installed state.

The first side face cover 54 has a bottom portion that is open. In other words, the first side face cover 54 has an open portion 54*a* that is open downward. The open portion 54*a* functions as a "lower opening" through which the electric wires (the low-voltage wires 91 and high-voltage wires 96) to be drawn into the inner space SP through the third hole 52*c* pass. In other words, the low-voltage wires 91 and the high-voltage wires 96 are drawn into the first side face cover 54 and the inner space SP through the open portion 54*a*.

The first side face cover 54 is inserted into the third hole 52*c* with the upper-side bent part 547 brought into contact with an inner face of an upper edge of the third hole 52*c* via the seal member. The first side face cover 54 is then fastened to the right side face part 523 of the main body frame 52 with screws such that the rear-side bent part 545 is located outside a front end of the third hole 52*c* and the front-side bent part 546 is located outside a rear end of the third hole 52*c*.

Figure 23:
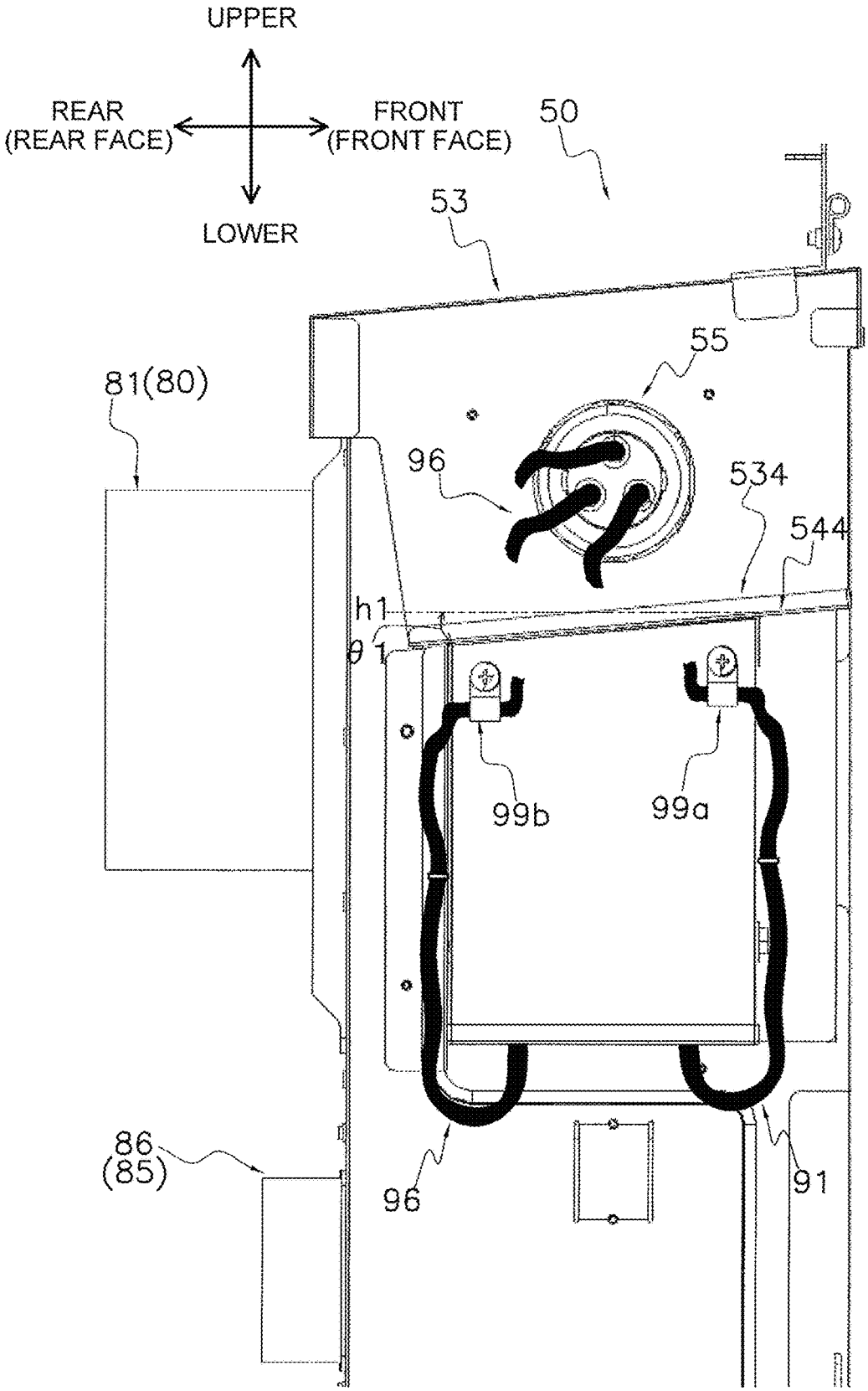
FIG. 23 is an enlarged view of segment A in FIG. 11.

As illustrated in FIG. 23, the upper part 544 of the first side face cover 54 is tilted rearward on a down grade such that liquid adhering to an upper face of the first side face cover 54 drips rearward without entering the third hole 52*c* in the installed state. FIG. 23 is an enlarged view of segment A in FIG. 11. As illustrated in FIG. 23, the upper part 544 of the first side face cover 54 is tilted at an angle corresponding to an angle θ1 relative to a horizontal line h1 in the installed state. The angle θ1 may be appropriately set in accordance with design specifications and installation environments. According to one or more embodiments, the angle θ1 is set at 15 degrees.

(5-3) Second Side Face Cover 55

The second side face cover 55 is a cover externally covering the fourth hole 52*d* in the right side face part 523 of the main body frame 52 from above and from sideward so as to suppress the entry of liquid into the inner space SP through the fourth hole 52*d* in the main body frame 52. The second side face cover 55 is a general-purpose product that is commonly available. The second side face cover 55 has a plurality of (three in one or more embodiments) openings through which the power wires (the high-voltage wires 96) connected to the compressor 12 pass.

(6) Details of Third Hole 52*c* and Drawn States of Wires

Figure 24:
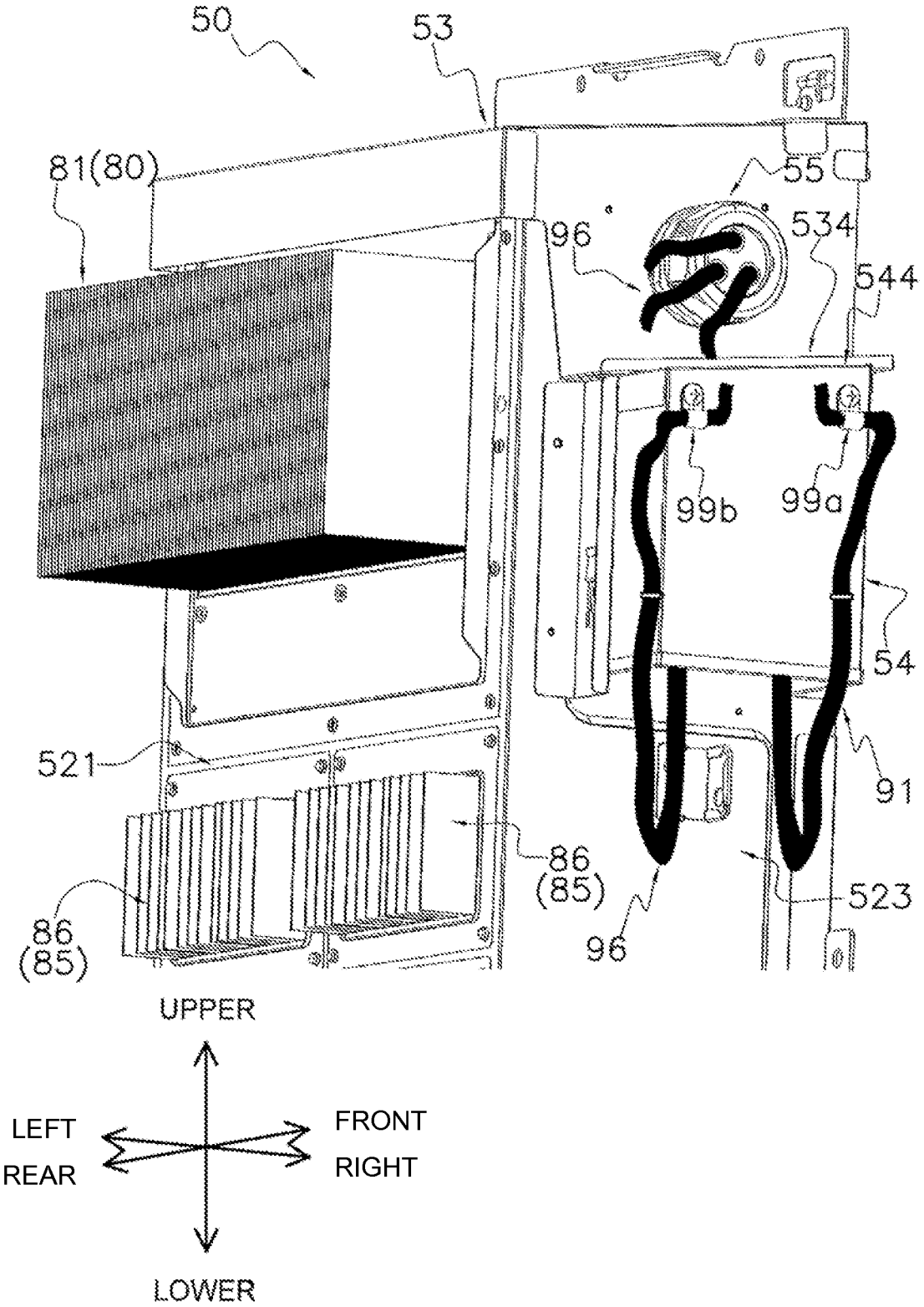
FIG. 24 is a rear perspective view of a state illustrated in FIG. 23.
Figure 25:
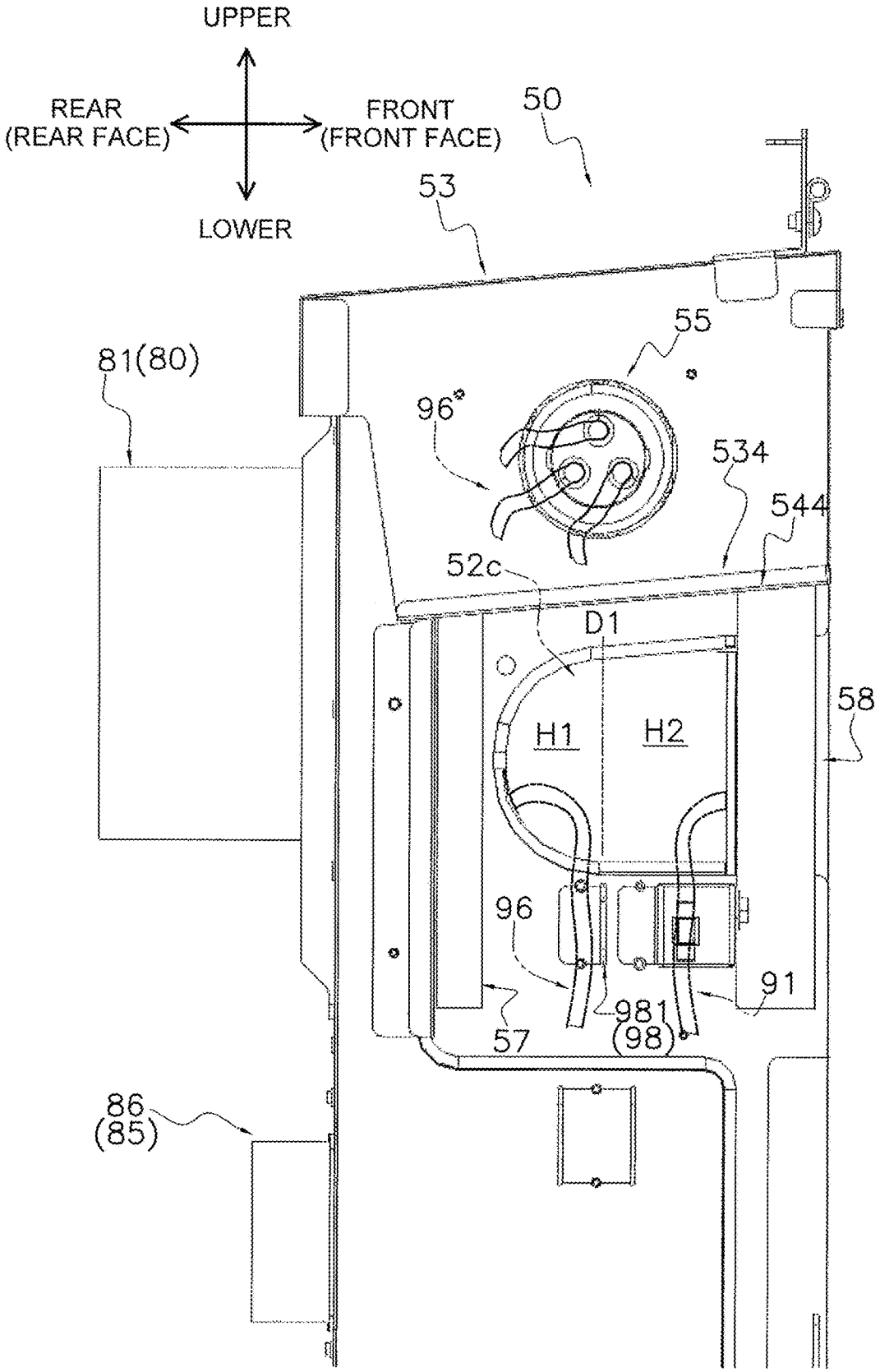
FIG. 25 is a view of the state illustrated in FIG. 23, which does not illustrate the first side face cover.
Figure 26:
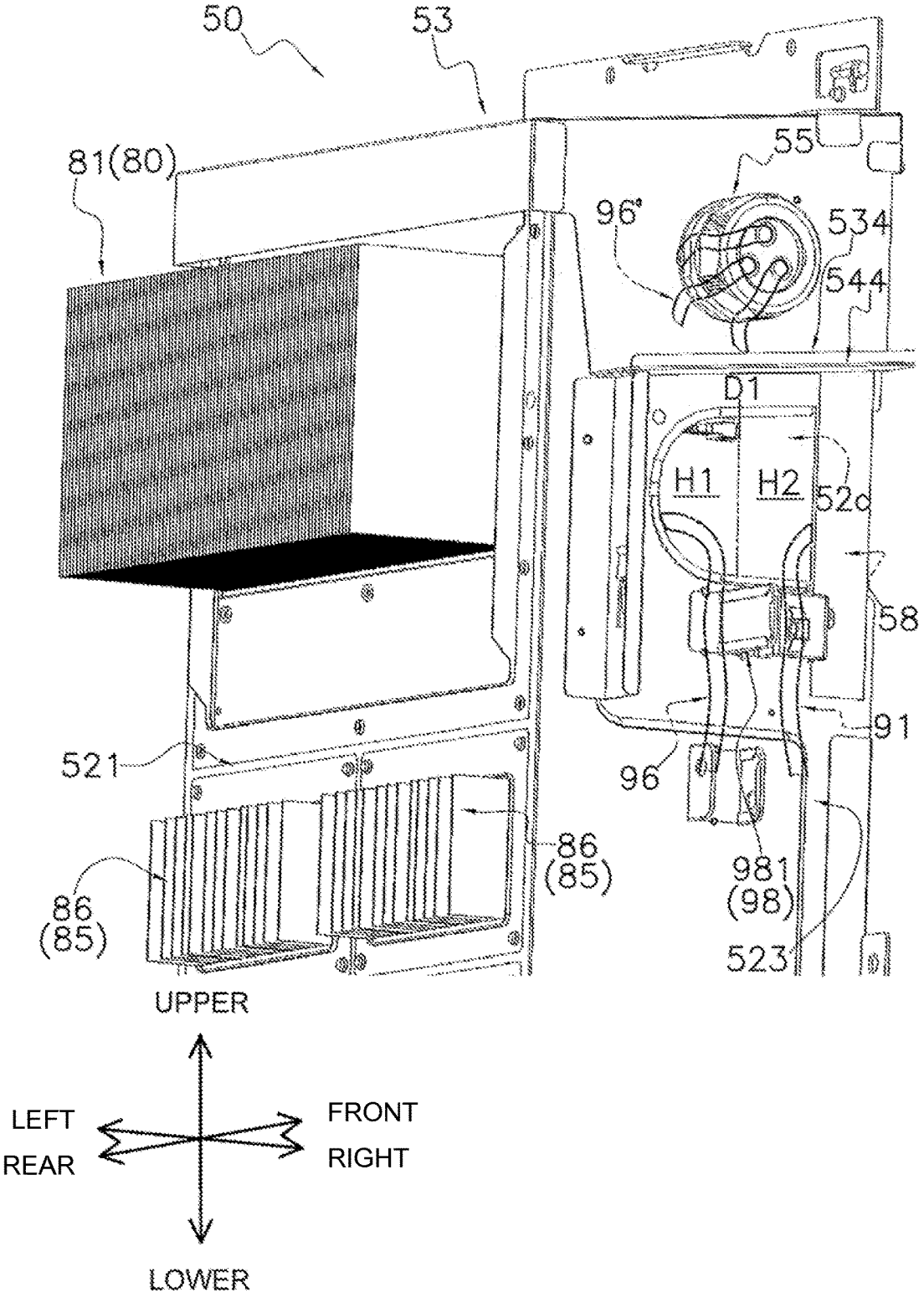
FIG. 26 is a rear perspective view of a state illustrated in FIG. 25.

FIG. 24 is a rear perspective view of a state illustrated in FIG. 23. FIG. 25 is a view of the state illustrated in FIG. 23, which does not illustrate the first side face cover 54. FIG. 26 is a rear perspective view of a state illustrated in FIG. 25.

As illustrated in FIGS. 23 to 26, the low-voltage wires 91 and the high-voltage wires 96 are drawn into the electric component box 50 through the third hole 52*c*. In addition, the high-voltage wires 96 are drawn into the electric component box 50 through the fourth hole 52*d*.

A large number of (110 in one or more embodiments) low-voltage wires 91 are drawn into the electric component box 50 through the third hole 52*c*. For example, the low-voltage wires 91 are tied together into a bundle. In other words, the low-voltage wires 91 drawn into the electric component box 50 are a low-voltage wire group of a large number of low-voltage wires 91 that are tied together into a bundle.

A large number of (36 in one or more embodiments) high-voltage wires 96 are drawn into the electric component box 50 through the third hole 52*c*. For example, the high-voltage wires 96 are tied together into a bundle. In other words, the high-voltage wires 96 drawn into the electric component box 50 are a high-voltage wire group of a large number of high-voltage wires 96 that are tied together into a bundle.

The low-voltage wires 91 are apt to generate noise if the low-voltage wires 91 are disposed in proximity to the high-voltage wires 96 by a predetermined distance (e.g., 3 cm) or more. In view of this, as illustrated in FIGS. 23 to 26, the low-voltage wires 91 and the high-voltage wires 96 are separately drawn into the electric component box 50 through the third hole 52*c* independently of each other, and are spaced apart from each other by a distance that ensures reliability for noise.

One or more embodiments adopt a plurality of members that facilitate drawing of the low-voltage wires 91 and the high-voltage wires 96 in the manner described above. For example, a partition 98 is disposed on the electric component box 50 (the right side face part 523) to suppress (i.e., prevent) a situation in which the low-voltage wires 91 and high-voltage wires 96 to be drawn into the third hole 52*c* come close to each other. The partition 98 includes a partition plate 981 that is thick in the front-rear direction and extends in the vertical direction and the left-right direction. The partition plate 981 of the partition 98 separates the low-voltage wires 91 from the high-voltage wires 96 to suppress the situation in which the low-voltage wires 91 and the high-voltage wires 96 come close to each other.

In addition, a first clamp 99*a* and a second clamp 99*b* are disposed in the front-rear direction at a position near the upper end of the right-side part 541 of the first side face cover 54. The first clamp 99*a* secures the bundle of low-voltage wires 91 at a position away from the high-voltage wires 96. The second clamp 99*b* secures the bundle of high-voltage wires 96.

As illustrated in FIGS. 25 and 26, the third hole 52*c* may be conceptually interpreted as continuity of a high-voltage wire through-hole H1 (which is an example of a "first opening" in the claims) through which the high-voltage wires 96 are drawn, and a low-voltage wire through-hole H2 (which is an example of a "second opening" in the claims) through which the low-voltage wires 91 are drawn. As illustrated in FIGS. 25 and 26, the high-voltage wire through-hole H1 and the low-voltage wire through-hole H2 are adjacent to each other in the front-rear direction across a chain double-dashed line D1.

In other words, the electric component box 50 may be interpreted as having in its lateral side two openings (the high-voltage wire through-hole H1 and the low-voltage wire through-hole H2). Specifically, the third hole 52*c* may be interpreted as a "wire through-hole" that is a combination of two openings (the high-voltage wire through-hole H1 and the low-voltage wire through-hole H2). According to one or more embodiments, the third hole 52*c* serves as both of the high-voltage wire through-hole H1 and the low-voltage wire through-hole H2.

It is necessary to particularly consider countermeasures against the entry of liquid into the inner space SP in relation to the high-voltage wire through-hole H1 and low-voltage wire through-hole H2 formed in the side face of the electric component box 50. According to one or more embodiments, however, the first side face cover 54 covers the high-voltage wire through-hole H1 and the low-voltage wire through-hole H2 from above to suppress the entry of liquid into the inner space SP. In addition, the single first side face cover 54 suppresses the entry of liquid into the high-voltage wire through-hole H1 through which the high-voltage wires 96 are drawn and the entry of liquid into the low-voltage wire through-hole H2 through which the low-voltage wires 91 are drawn. In other words, the first side face cover 54 is disposed for both the high-voltage wire through-hole H1 and the low-voltage wire through-hole H2, which leads to cost reduction.

(7) Features 7-1

In an outdoor unit for a refrigeration apparatus, typically, a compressor is disposed on a bottom plate of a casing, and an electric component for power supply to the compressor is housed in an electric component box disposed in the casing. In some of such outdoor units, an electric wire (a power supply wire) connecting a compressor to an electric component for power supply to the compressor is drawn into an electric component box, in which the electric component is housed, from a lateral side of the electric component box for the purpose of cost cutting, noise reduction, or ease of wiring by reduction in longitudinal length.

In this respect, electric wires to be drawn into an electric component box include: a wire (a high-voltage wire) for supplying electric power as a power source for a device (e.g., an actuator such as a compressor, a heater); and a wire (a low-voltage wire) for sending a control signal to be exchanged between devices (e.g., a sensor, a microcomputer). If the low-voltage wire and the high-voltage wire are disposed in proximity to each other, the low-voltage wire may generate noise. In order to suppress decrease in reliability, normally, the low-voltage wire and the high-voltage wire are separately drawn into an electric component box.

Meanwhile, an outdoor unit for a refrigeration apparatus requires countermeasures against the entry of liquid into an electric component box. However, the countermeasures are taken individually for a portion where a high-voltage wire is drawn and a portion where a low-voltage wire is drawn, which may result in increase in cost.

In the outdoor unit 10 according to one or more embodiments, the cover unit 56 configured to suppress the entry of liquid into the electric component box 50 is disposed on the outer face of the electric component box 50, and is located along the high-voltage wire through-hole H1 through which the high-voltage wires 96 are drawn into the electric component box 50 and the low-voltage wire through-hole H2 through which the low-voltage wires 91 are drawn into the electric component box 50. In addition, the cover unit 56 covers both the high-voltage wire through-hole H1 and the low-voltage wire through-hole H2 from above and from sideward. As described above, the high-voltage wires 96 and the low-voltage wires 91 are separately drawn into the electric component box 50, and the high-voltage wire through-hole H1 through which the high-voltage wires 96 are drawn and the low-voltage wire through-hole H2 through which the low-voltage wires 91 are drawn are covered with the common cover unit 56. This configuration therefore simply and accurately suppresses the entry of liquid into the electric component box 50 while achieving reduction in parts count. This configuration thus suppresses decrease in reliability, and also suppresses increase in cost for suppressing the entry of liquid into the electric component box 50.

7-2

In the outdoor unit 10 according to one or more embodiments, the outdoor unit casing 40 has the blow-out port 402 through which an outdoor air flow AF is blown out upward. In addition, the outdoor fan 18 provides an outdoor air flow AF flowing from below upward in the outdoor unit casing 40 and flowing out of the outdoor unit casing 40 through the blow-out port 402. The outdoor unit 10 suppresses the entry of liquid into the electric component box 50 while reducing cost even when the outdoor unit 10 has the blow-out port 402 through which an outdoor air flow AF is blown out upward, that is, even when the outdoor unit 10 particularly has a concern of the entry of liquid into the outdoor unit casing 40 through the blow-out port 402.

7-3

In the outdoor unit 10 according to one or more embodiments, the electric component box 50 or the cover unit 56 has the partition 98. In addition, the partition 98 separates the high-voltage wires 96 to be drawn into the high-voltage wire through-hole H1 from the low-voltage wires 91 to be drawn into the low-voltage wire through-hole H2. This configuration thus suppresses the situation in which the high-voltage wires 96 to be drawn into the high-voltage wire through-hole H1 and the low-voltage wires 91 to be drawn into the low-voltage wire through-hole H2 come close to each other. As a result, the low-voltage wires 91 are less prone to suffer from noise to be caused when the low-voltage wires 91 are disposed in proximity to the high-voltage wires 96.

7-4

In the outdoor unit 10 according to one or more embodiments, the high-voltage wire through-hole H1 and the low-voltage wire through-hole H2 are lower in heightwise position than the upper end of the board unit 75 and higher in heightwise position than the lower end of the board unit 75. In this regard, the high-voltage wire through-hole H1 and the low-voltage wire through-hole H2 are located in proximity to each other. As a result, the cover unit 56 readily covers both the high-voltage wire through-hole H1 and the low-voltage wire through-hole H2, which facilitates cost cutting.

7-5

In the outdoor unit 10 according to one or more embodiments, the high-voltage wires 96 and the low-voltage wires 91 are separately drawn into the electric component box 50 through the third hole 52*c* (the wire through-hole) serving as both of the high-voltage wire through-hole H1 and the low-voltage wire through-hole H2. With this configuration, the common cover unit 56 readily covers both the portion where the high-voltage wires 96 are drawn and the portion where the low-voltage wires 91 are drawn, which facilitates cost cutting.

7-6

In the outdoor unit 10 according to one or more embodiments, the number of high-voltage wires 96 to be drawn into the high-voltage wire through-hole H1 is equal to or more than 15. In addition, the number of low-voltage wires 91 to be drawn into the low-voltage wire through-hole H2 is also equal to or more than 15. The outdoor unit 10 suppresses decrease in reliability, and also suppresses increase in cost for suppressing the entry of liquid into the electric component box 50 even when the number of electric wires to be drawn into the electric component box 50 is large, leading to a concern particularly about decrease in reliability owing to noise and increase in cost for suppressing the entry of liquid.

7-7

In the outdoor unit 10 according to one or more embodiments, the first side face cover 54 (the cover unit 56) has the "lower opening" (the open portion 54*a*) that is open downward. In addition, the high-voltage wires 96 and the low-voltage wires 91 are drawn into the first side face cover 54 and the electric component box 50 through the "lower opening". This configuration simplifies the "cover part" configured to suppress the entry of liquid into the high-voltage wire through-hole H1 and the low-voltage wire through-hole H2.

7-8)

In the outdoor unit 10 according to one or more embodiments, the cover unit 56 includes the first side face cover 54 and the top face cover 53. In addition, the top face cover 53 (the flange part 534) is located above the first side face cover 54, and covers the first side face cover 54 from above. This configuration suppresses the entry of liquid into the electric component box 50 more reliably.

(8) Modifications

The foregoing embodiments may be appropriately modified as described in the following modifications. It should be noted that these modifications are applicable in conjunction with other modifications insofar as there are no inconsistencies.

(8-1) Modification 1

According to the foregoing embodiments, the third hole 52*c* serves as both of the high-voltage wire through-hole H1 and the low-voltage wire through-hole H2. In other words, the high-voltage wire through-hole H1 and the low-voltage wire through-hole H2 are integrated as one hole. However, the present invention is not limited thereto. The high-voltage wire through-hole H1 and the low-voltage wire through-hole H2 are not necessarily integrated into one. Alternatively, the high-voltage wire through-hole H1 and the low-voltage wire through-hole H2 may be formed independently of each other.

Figure 27:
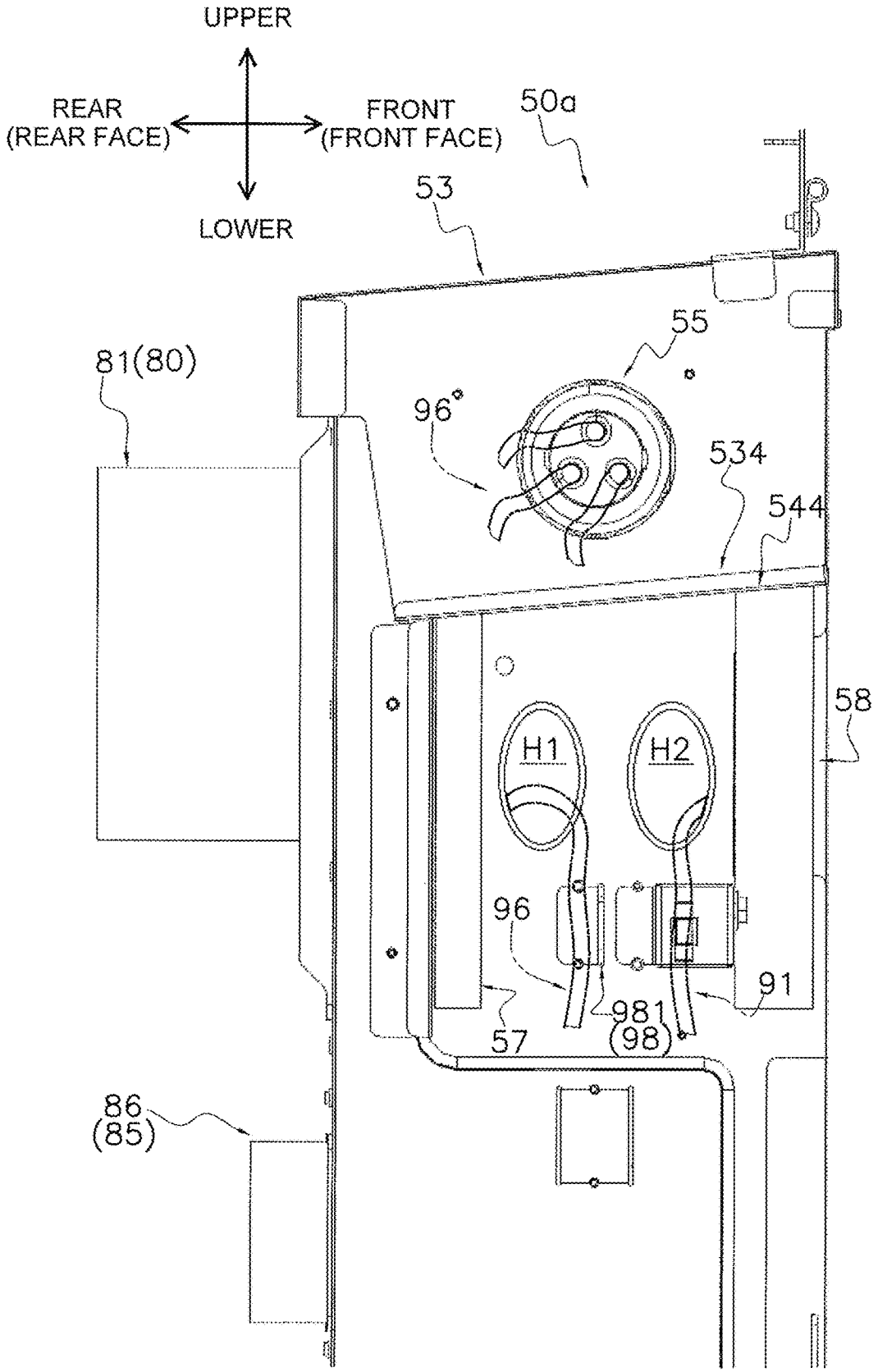
FIG. 27 is a view of an electric component box according to Modification 1, which corresponds to FIG. 25.

As illustrated in FIG. 27, for example, an electric component box 50*a* has a high-voltage wire through-hole H1 and a low-voltage wire through-hole H2 that are formed independently of each other so as to definitely separate low-voltage wires 91 from high-voltage wires 96. This case also produces functions and effects similar to those in the foregoing embodiments as long as a common cover unit 56 externally covers the high-voltage wire through-hole H1 and the low-voltage wire through-hole H2 from above and from sideward.

The high-voltage wire through-hole H1 and the low-voltage wire through-hole H2 are not necessarily arranged horizontally. The high-voltage wire through-hole H1 and the low-voltage wire through-hole H2 may be arranged in the upper-lower direction. In this case, increasing the heightwise length of the first side face cover 54 enables the single first side face cover 54 to externally cover both the high-voltage wire through-hole H1 and the low-voltage wire through-hole H2 from above and from sideward.

(8-2) Modification 2

In the foregoing embodiments, the partition 98 includes the partition plate 981 that is thick in the front-rear direction and extends in the vertical direction and the left-right direction. The partition plate 981 separates the low-voltage wires 91 from the high-voltage wires 96 to suppress the situation in which the low-voltage wires 91 and the high-voltage wires 96 come close to each other. However, the configuration of the partition 98 is not limited as long as the partition 98 keeps the distance between the low-voltage wires 91 to be drawn into the third hole 52*c* and the high-voltage wires 96 to be drawn into the third hole 52*c* to a degree that the low-voltage wires 91 are less prone to generate noise.

Figure 28:
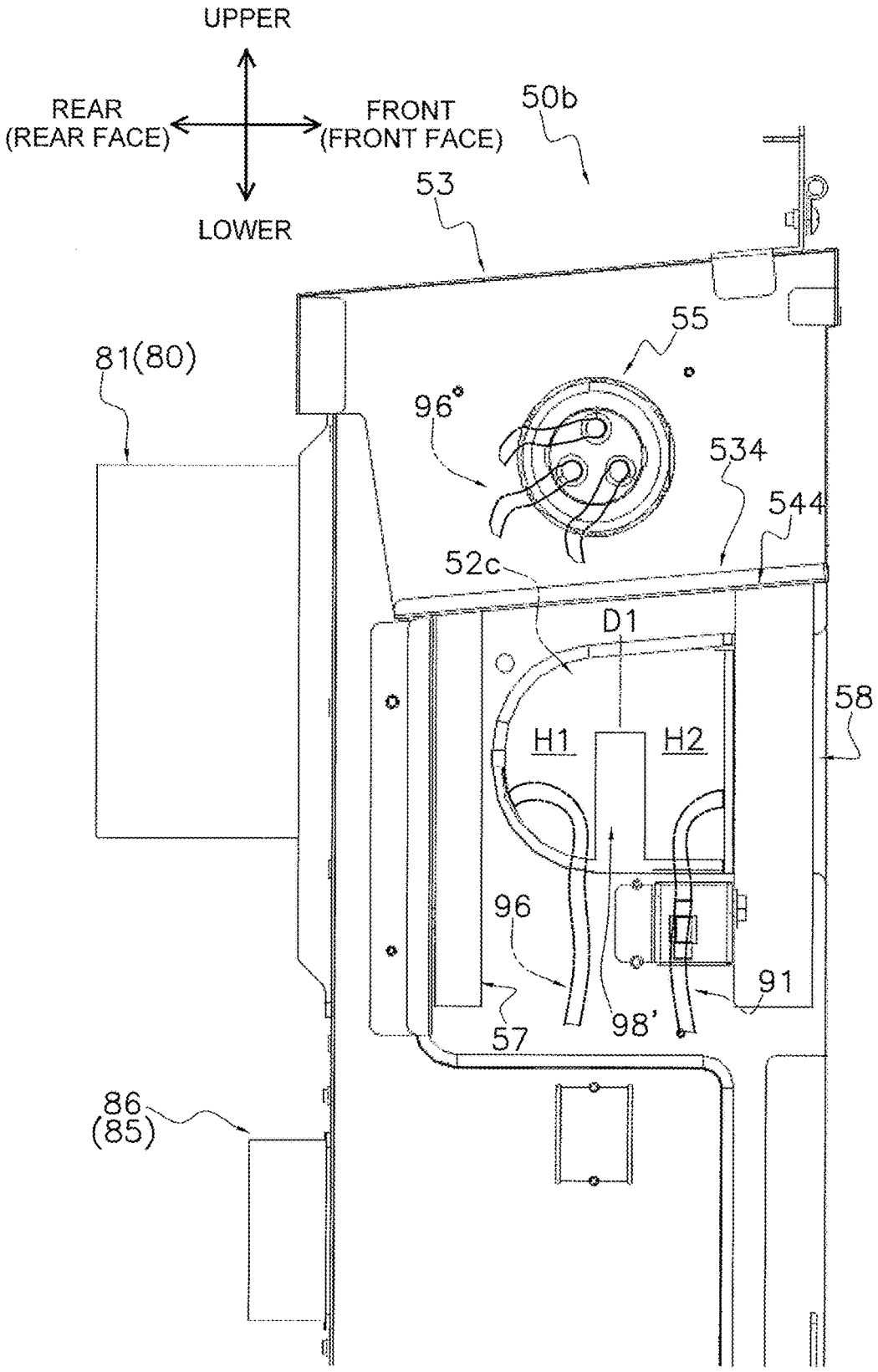
FIG. 28 is a view of an electric component box according to Modification 2, which corresponds to FIG. 25.

As illustrated in FIG. 28, for example, an electric component box 50*b* includes a part "98'" that functions as a "partition" at an edge of a third hole 52*c*, depending on how the third hole 52*c* is formed in a main body frame 52. As illustrated in FIG. 28, the third hole 52*c* is formed in the main body frame 52 with the partition 98' located between a high-voltage wire through-hole H1 and a low-voltage wire through-hole H2 in such a manner that the main body frame 52 is subjected to punching leaving a portion corresponding to the partition 98' at a central portion of the third hole 52*c*. The partition illustrated in FIG. 28 partially separates the high-voltage wire through-hole H1 and the low-voltage wire through-hole H2 from each other although the high-voltage wire through-hole H1 and the low-voltage wire through-hole H2 communicate with each other in the third hole 52*c*.

(8-3) Modification 3

In the foregoing embodiments, the electric component box 50 has the partition 98 separating the low-voltage wires 91 to be drawn into the third hole 52*c* from the high-voltage wires 96 to be drawn into the third hole 52*c*. However, the partition 98 is not necessarily disposed inside the electric component box 50. For example, the partition 98 may be disposed inside the first side face cover 54.

Alternatively, the partition 98 is not necessarily provided and may be appropriately omitted as long as the distance between the low-voltage wires 91 to be drawn into the third hole 52*c* and the high-voltage wires 96 to be drawn into the third hole 52*c* is kept to the degree that the low-voltage wires 91 are less prone to generate noise.

(8-4) Modification 4

In the foregoing embodiments, the high-voltage wire through-hole H1 and the low-voltage wire through-hole H2 are lower in heightwise position than the upper end of the board unit 75 and higher in heightwise position than the lower end of the board unit 75. In this respect, the high-voltage wire through-hole H1 and the low-voltage wire through-hole H2 may be located as described above from the viewpoint that the high-voltage wire through-hole H1 and the low-voltage wire through-hole H2 are located in proximity to each other such that the cover unit 56 readily covers both the high-voltage wire through-hole H1 and the low-voltage wire through-hole H2.

However, the high-voltage wire through-hole H1 and the low-voltage wire through-hole H2 are not necessarily located as described above as long as the common cover unit 56 externally covers the high-voltage wire through-hole H1 and the low-voltage wire through-hole H2 from above and from sideward. In other words, the high-voltage wire through-hole H1 and the low-voltage wire through-hole H2 may be higher in heightwise position than the upper end of the board unit 75 or may be lower in heightwise position than the lower end of the board unit 75 as long as there arises no contradiction as to the functions and effects described in Feature (7-1).

(8-5) Modification 5

In the foregoing embodiments, the high-voltage wires 96 led from the compressor 12 are individually drawn into the electric component box 50 through the opening (the fourth hole 52*d*) different from the opening through which the other high-voltage wires 96 are drawn. However, the present invention is not limited thereto. Alternatively, the high-voltage wires 96 led from the compressor 12 may be drawn together with the other high-voltage wires 96 into the electric component box 50 through the third hole 52*c* (the high-voltage wire through-hole H1).

(8-6) Modification 6

In the foregoing embodiments, the low-voltage components 90 and the high-voltage components 95 are respectively mounted on the different boards. However, the present invention is not limited thereto. The low-voltage components 90 and the high-voltage components 95 may be mounted on a single board as long as the reliability is ensured. For example, the low-voltage components 90 mounted on the control board 71 may be mounted on the compressor control board 76 or the fan control board 77.

(8-7) Modification 7

In the foregoing embodiments, the devices connected to the high-voltage wires 96 are actuators (e.g., the compressor 12, the outdoor fans 18). However, the devices connected to the high-voltage wires 96 are not limited to actuators. For example, the devices connected to the high-voltage wires 96 may be, for example, an electric heater configured to apply heat when being energized.

(8-8) Modification 8

In the foregoing embodiments, the top face cover 53 includes, as a part thereof, the flange part 534 located above the first side face cover 54 and configured to suppress the entry of liquid into the inner space SP through the third hole 52*c*. However, the top face cover 53 does not necessarily include the flange part 534. For example, another member may include the flange part 534. Alternatively, the flange part 534 may be provided as an independent member.

(8-9) Modification 9

In the foregoing embodiments, the second side face cover 55 is provided to suppress the entry of liquid through the fourth hole 52*d*. However, the second side face cover 55 may be appropriately omitted if it is not necessarily needed from the viewpoint of reliability. In such a case, only the first side face cover 54 may externally cover both the third hole 52*c* and the fourth hole 52*d* from above and from sideward by increasing the heightwise length of the first side face cover 54 and placing the first side face cover 54 above the fourth hole 52*d*.

(8-10) Modification 10

In the foregoing embodiments, the top face cover 53 is disposed above the electric component box 50 to mainly suppress the entry of liquid into the electric component box 50 through the third hole 52*c* and fifth holes 52*e*. In this respect, the top face cover 53 may be disposed as described above in the foregoing embodiments from the viewpoint of reliably suppressing the entry of liquid into the electric component box 50 through the third hole 52*c* and fifth holes 52*e*. However, the top face cover 53 is not necessarily provided and may be appropriately omitted as long as the reliability is ensured as to suppress the entry of liquid into the electric component box 50.

(8-11) Modification 11

In the foregoing embodiments, the outdoor unit 10 is of an upward blowing type. Specifically, the outdoor unit 10 has in its top face the blow-out port 402, and an outdoor air flow AF mainly flows from below upward in the outdoor unit casing 40, and is blown out upward through the blow-out port 402. However, the present invention is not limited thereto. The outdoor unit 10 may be of any type.

For example, the outdoor unit 10 may be of a sideward blowing type. Specifically, the outdoor unit 10 has in its front face portion the blow-out port 402, and an outdoor air flow AF is blown out horizontally through the blow-out port 402. In this case, the outdoor fan 18 may be disposed to provide an outdoor air flow AF mainly flowing horizontally in the outdoor unit casing 40. In other words, the outdoor fan 18 may be disposed such that its axis extends horizontally.

(8-12) Modification 12

In the foregoing embodiments, on the assumption that the outdoor unit 10' includes two outdoor fans 18, two fan control boards 77 (fan controlling electric components 66) are arranged side by side in the left-right direction in the electric component box 50. As illustrated in, for example, FIGS. 2 to 4, however, one fan control board 77 may be disposed in the electric component box 50 as to the outdoor unit 10 including one outdoor fan 18. In other words, one of the two fan control boards 77 illustrated in, for example, FIG. 12 may be appropriately omitted. In such a case, the second cooling unit 85 corresponding to the omitted fan control board 77 is also omitted.

(8-13) Modification 13

In the foregoing embodiments, the board unit 75 includes the compressor control board 76 and the fan control boards 77, the compressor controlling electric component mount portion 75*a* is disposed on the compressor control board 76, and the fan controlling electric component mount portions 75*b* are respectively disposed on the fan control boards 77. In the foregoing embodiments, specifically, the compressor controlling electric components 63 are mounted on the compressor control board 76, and the fan controlling electric components 66 are respectively mounted on the fan control boards 77. In other words, the compressor controlling electric components 63 and the fan controlling electric components 66 are respectively mounted on the different boards.

However, the present invention is not limited thereto. Alternatively, the compressor controlling electric components 63 and the fan controlling electric components 66 may be mounted on a single board. In other words, the compressor controlling electric component mount portion 75*a* and the fan controlling electric component mount portions 75*b* may be disposed on a single board. In other words, the board unit 75 does not necessarily include a plurality of boards.

(8-14) Modification 14

In the foregoing embodiments, the configuration of the refrigerant circuit RC is not limited to that illustrated in FIG. 1, and may be appropriately changed in accordance with design specifications and installation environments. For example, the accumulator 11 and the outdoor expansion valve 16 may be appropriately omitted if they are not necessarily needed. In addition, the refrigerant circuit RC may additionally include a device (e.g., a receiver) not illustrated in FIG. 1.

(8-15) Modification 15

In the foregoing embodiments, the present invention is applied to the air conditioning system 100 including one outdoor unit 10 and two indoor units 30 connected to the outdoor unit 10 in parallel via the connection pipes (L1, G1). However, a configuration of an air conditioning system to which the present invention is applied is not limited to this configuration. Specifically, as to an air conditioning system to which the present invention is applied, the number of outdoor units 10 and/or indoor units 30 and the connection of an outdoor unit 10 and an indoor unit 30 may be appropriately changed in accordance with installation environments and design specifications.

(8-16) Modification 16

In the foregoing embodiments, the present invention is applied to the air conditioning system 100. However, the present invention is not limited thereto and is applicable to any refrigeration apparatus (e.g., a water heater, a heat pump chiller) including a refrigerant circuit.

The present invention is applicable to an outdoor unit for a refrigeration apparatus.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10, 10': outdoor unit
12: compressor
18: outdoor fan (fan)
19: outdoor-side sensor
20: outdoor unit control unit
30: indoor unit
40, 40': outdoor unit casing (casing)
50, 50*a*, 50*b*: electric component box
51: front face cover
52: main body frame
52*a*: first hole
52*b*: second hole
52*c*: third hole (wire through-hole)
52*d*: fourth hole
52*e*: fifth hole
52*e*1: edge part
52*f*: sixth hole
53: top face cover (second cover member)
54: first side face cover (first cover member)
54*a*: open portion (lower opening)
55: second side face cover
56: cover unit (cover part)
57, 58: seal member
63: compressor controlling electric component
65: power module
66: fan controlling electric component
71: control board (board)
75: board unit (board)
75*a*: compressor controlling electric component mount portion
75*b*: fan controlling electric component mount portion
76: compressor control board (board)
77: fan control board (board)
90: low-voltage component (second electric component)
91: low-voltage wire (second wire)
95: high-voltage component (first electric component)
96: high-voltage wire (first wire)
98, 98': partition
99*a*: first clamp
99*b*: second clamp
100: air conditioning system
402: blow-out port
501: vertical plate
521: rear face part
522: left side face part
523: right side face part
524: top face part
531: upper cover part
532: left lateral cover part
533: right lateral cover part
534: flange part
541: right-side part
542: front-side part
543: rear-side part
544: upper part
545: rear-side bent part
546: front-side bent part
547: upper-side bent part
981: partition plate
AF: outdoor air flow (air flow)
E1: electric component
H1: high-voltage wire through-hole (first opening)
H2: low-voltage wire through-hole (second opening)
RC: refrigerant circuit
S1: air blowing space
SP: inner space
SP1: lower space
SP2: upper space
SP2*a*: front-side upper space
SP2*b*: rear-side upper space

The invention claimed is:

1. An outdoor unit for a refrigeration apparatus, the outdoor unit comprising:

a casing housing therein a plurality of devices;

an electric component including a high-voltage component and a low-voltage component;

an electric component box housing therein the electric component, wherein the electric component box is disposed in the casing;

a first wire that carries a voltage or a current between the high-voltage component and any one of the devices corresponding to the high-voltage component;

a second wire that carries a voltage or a current between the low-voltage component and another one of the devices corresponding to the low-voltage component, wherein the voltage or current fed to the second wire is smaller than the voltage or current fed to the first wire; and a cover that prevents entry of liquid into the electric component box, wherein the electric component box has in a lateral side of the electric component box a first opening through which the first wire is drawn into the electric component box and a second opening through which the second wire is drawn into the electric component box, the cover is disposed on an outer face of the electric component box along the first opening and the second opening and covers both the first opening and the second opening from above and sideward of the first opening and the second opening, and the electric component box or the cover has a partition that maintains separation between the first wire and the second wire, wherein the electric component box has a wire through-hole serving as both of the first opening and the second opening, the first wire and the second wire are separately drawn into the electric component box through the wire through-hole, and the cover is disposed along the wire through-hole and covers the wire through-hole from above and sideward of the wire through-hole.

2. The outdoor unit according to claim 1, wherein the devices include a fan that provides air flow, the casing has a blow-out port through which the air flow is blown out in an upward direction, and the air flow is a flow of air flowing, from below the casing, in the upward direction in the casing and flowing out of the casing through the blow-out port.

3. The outdoor unit according to claim 1, further comprising:

a board on which the electric component is mounted, wherein the first opening and the second opening are lower in heightwise position than an upper end of the board and higher in heightwise position than a lower end of the board.

4. The outdoor unit according to claim 1, wherein 15 or more first wires are drawn into the first opening, and 15 or more second wires are drawn into the second opening.

5. The outdoor unit according to claim 1, wherein the cover has a lower opening that is open downward, and the first wire and the second wire are drawn into the cover and the electric component box through the lower opening.

6. The outdoor unit according to claim 1, wherein the cover includes a first cover member and a second cover member, and the second cover member is located above the first cover member and covers the first cover member from above.

7. The outdoor unit according to claim 1, wherein the partition is disposed between the first wire and the second wire.

8. The outdoor unit according to claim 1, wherein the partition is disposed between the first opening and the second opening.

9. An outdoor unit for a refrigeration apparatus, the outdoor unit comprising:

a casing housing therein a plurality of devices;

an electric component including a high-voltage component and a low-voltage component;

an electric component box housing therein the electric component, wherein the electric component box is disposed in the casing;

a first wire that carries a voltage or a current between the high-voltage component and any one of the devices corresponding to the high-voltage component;

a second wire that carries a voltage or a current between the low-voltage component and another one of the devices corresponding to the low-voltage component, wherein the voltage or current fed to the second wire is smaller than the voltage or current fed to the first wire; and a cover that prevents entry of liquid into the electric component box, wherein the electric component box has a first opening through which the first wire is drawn into the electric component box and a second opening through which the second wire is drawn into the electric component box, the first opening and the second opening are disposed separately on a lateral side of the electric component box, and the cover is disposed on an outer face of the electric component box along the first opening and the second opening and covers both the first opening and the second opening from above and sideward of the first opening and the second opening, wherein the electric component box has a wire through-hole serving as both of the first opening and the second opening, the first wire and the second wire are separately drawn into the electric component box through the wire through-hole, and the cover is disposed along the wire through-hole and covers the wire through-hole from above and sideward of the wire through-hole.

10. The outdoor unit according to claim 9, wherein the electric component box or the cover has a plate that maintains separation between the first wire and the second wire.

11. The outdoor unit according to claim 9, wherein the devices include a fan that provides air flow, the casing has a blow-out port through which the air flow is blown out in an upward direction, and the air flow is a flow of air flowing, from below the casing, in the upward direction in the casing and flowing out of the casing through the blow-out port.

12. The outdoor unit according to claim 9, further comprising:

a board on which the electric component is mounted, wherein the first opening and the second opening are lower in heightwise position than an upper end of the board and higher in heightwise position than a lower end of the board.

13. The outdoor unit according to claim 9, wherein 15 or more first wires drawn into the first opening, and 15 or more second wires drawn into the second opening.

14. The outdoor unit according to claim 9, wherein the cover has a lower opening that is open downward, and the first wire and the second wire are drawn into the cover and the electric component box through the lower opening.

15. The outdoor unit according to claim 9, wherein the cover includes a first cover member and a second cover member, and the second cover member is located above the first cover member and covers the first cover member from above.

* * * * *